US006057089A

United States Patent [19]

Matsumoto et al.

[11] Patent Number: 6,057,089

[45] **Date of Patent: *May 2, 2000**

[54] SILVER HALIDE PHOTOGRAPHIC LIGHT-SENSITIVE MATERIAL

[75] Inventors: Jun Matsumoto; Takanori Hioki; Tetsuo Nakamura, all of Minami-Ashigara, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,919

[22] Filed: Jan. 16, 1997

[30] Foreign Application Priority Data

Jan. 29, 1996 [JP] Japan ..... 8-012755

[51] Int. Cl.[7] ..... G03C 1/12; G03C 1/33

[52] U.S. Cl. ..... 430/584; 430/505; 430/569; 430/581; 430/582; 430/611

[58] Field of Search ..... 430/584, 581, 430/582, 495–595, 611, 569

[56] References Cited

U.S. PATENT DOCUMENTS

| | | | |
|---|---|---|---|
| 3,892,574 | 7/1975 | Claes et al. . | |
| 3,957,490 | 5/1976 | Libeer et al. . | |
| 4,198,240 | 4/1980 | Mikawa | 430/570 |
| 5,254,449 | 10/1993 | James et al. | 430/533 |
| 5,290,676 | 3/1994 | Nagaoka et al. . | |
| 5,422,238 | 6/1995 | Ikegawa et al. . | |

*Primary Examiner*—Thorl Chea
*Attorney, Agent, or Firm*—Birch, Stewart, Kolasch & Birch, LLP

[57] ABSTRACT

A silver halide photographic light-sensitive material having at least one silver halide emulsion layer formed on a support, wherein silver halide grains in the emulsion layer are reduction-sensitized and contain at least one compound represented by formula (I) below.

Formula (I)

In formula (I), R is an alkyl group represented as follows.

Each of $R_a$, $R_b$, $R_c$, ad $R_d$ represents an alkyl group, an aryl group, a heterocyclic group, an alkoxy group, an aryloxy group, or an amino group, each of $Q_a$, $Q_b$, $Q_c$, and $Q_d$ represents a methylene group, and each of r, s, t, and u represents an integer from 1 to 10.

Each of $L_1$ and $L_2$ represents a methine group. p1 represents 0 or 1. $Z_1$ represents atom groups required to neutralize a 5- or 6-membered nitrogen-containing heterocyclic ring. $M_1$ represents a charge-balancing counterion, and $m_1$ represents a number from 0 to 10 required to form electric charge of a molecule. Q represents a methine group or a polymethine group substituted by a heterocyclic group or an aromatic group.

12 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material and, more particularly, to a silver halide photographic light-sensitive material having a high sensitivity, a low fog, and a high storage stability.

Conventionally, a lot of efforts have been made to increase the sensitivity of silver halide photographic light-sensitive materials. It is known that sensitizing dyes used for spectral sensitization have a large influence on the performance of silver halide photographic light-sensitive materials. A slight structural difference between sensitizing dyes has a large effect on photographic properties such as sensitivity, fog, and storage stability. Since it is difficult to predict the effect in advance, a large number of researchers have conventionally made efforts to synthesize a number of sensitizing dyes and examine the photographic properties of these dyes.

Also, to raise the sensitivity of silver halide photographic light-sensitive materials, reduction sensitization has been attempted for a long time. For example, U.S. Pat. No. 2,487,850, U.S. Pat. No. 2,512,925, and British Patent 789,823 have disclosed that a tin compound, a polyamine compound, and a thiourea dioxide-based compound, respectively, are useful as reduction sensitizers. Furthermore, "Photographic Science and Engineering", Vol. 23, page 113 (1979) compares the properties of silver nuclei formed by various reduction sensitization methods and uses methods using dimethylamineborane, stannous chloride, hydrazine, high-pH ripening, and low-pAg ripening. Methods of reduction sensitization are also disclosed in U.S. Pat. Nos. 2,518,698, 3,201,254, 3,411,917, 3,779,777, and 3,930,867. Improvements of reduction sensitization methods, as well as selection of reduction sensitizers, are described in JP-B-57-33572 ("JP-B" means Published Examined Japanese Patent Application) and JP-B-58-1410.

Unfortunately, the research by the present inventors has revealed that when spectral sensitization is performed by causing reduction-sensitized silver halide grains to adsorb sensitizing dyes, especially when green and red regions are spectrally sensitized, it is very difficult to obtain a sufficient spectral sensitivity without bringing about an action (e.g., an increase in fog) undesirable to photographic properties.

A method by which a sensitizing dye in a light-sensitive material is adsorbed at a high temperature (50° C. or higher) in order to prevent silver halide grains from adsorbing the sensitizing dye (especially when the humidity is high) or a method by which a sensitizing dye is adsorbed before chemical sensitization to increase the sensitivity is widely known. However, the fog is significantly raised when these methods are applied to a case where a reduction-sensitized emulsion is made to adsorb a spectral sensitizing dye in a green or red region.

For the reasons described above, a technique which spectrally sensitizes reduction-sensitized silver halide grains at a high sensitivity without giving rise to an adverse effect such as fog has been demanded.

BRIEF SUMMARY OF THE INVENTION

It is an object of the present invention to provide a silver halide photographic light-sensitive material having a high sensitivity, a low fog, and a high storage stability.

As a result of extensive studies, the object of the present invention can be achieved by a silver halide photographic light-sensitive material having at least one silver halide emulsion layer formed on a support, wherein silver halide grains in the emulsion layer are reduction-sensitized and contain at least one compound represented by formula (I) below.

Formula (I)

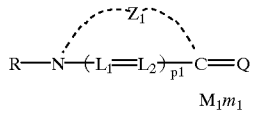

In formula (I), R is an alkyl group represented as follows.

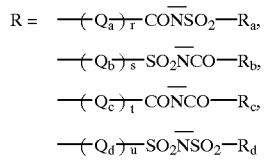

Each of $R_a$, $R_b$, $R_c$, ad $R_d$ represents an alkyl group, an aryl group, a heterocyclic group, an alkoxy group, an aryloxy group, or an amino group, each of $Q_a$, $Q_b$, $Q_c$, and $Q_d$ represents a methylene group, and each of r, s, t, and u represents an integer from 1 to 10.

Each of $L_1$ and $L_2$ represents a methine group. p1 represents 0 or 1. $Z_1$ represents atom groups required to neutralize a 5- or 6-membered nitrogen-containing heterocyclic ring. $M_1$ represents a charge-balancing counterion, and $m_1$ represents a number from 0 to 10 required to form electric charge of a molecule. Q represents a methine group or a polymethine group substituted by a heterocyclic group or an aromatic group.

A compound represented by formula (I) is more preferably a compound selected from formulas (III), (IV), and (V).

Formula (III)

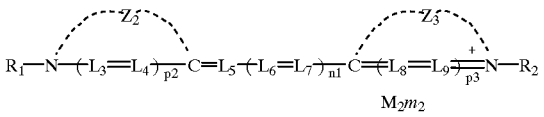

In formula (III), each of $L_3$, $L_4$, $L_5$, $L_6$, $L_7$, $L_8$, and $L_9$ represents a methine group. Each of p2 and p3 represents 0 or 1. n1 represents 0, 1, 2, or 3. Each of $Z_2$ and $Z_3$ represents atom groups required to form a 5- or 6-membered nitrogen-containing heterocyclic ring. $M_2$ represents a charge-balancing counterion, and $m_2$ represents a number from 0 to 4 required to neutralize electric charge of a molecule. Each of $R_1$ and $R_2$ represents an alkyl group. Note that at least one of $R_1$ and $R_2$ is a group represented by R in formula (I).

Formula (IV)

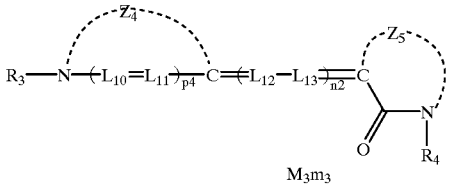

In formula (IV), each of $L_{10}$, $L_{11}$, $L_{12}$, and $L_{13}$ represents a methine group. p4 represents 0 or 1. n2 represents 0, 1, 2, or 3. Each of $Z_4$ and $Z_5$ represents atom groups required to form a 5- or 6-membered nitrogen-containing heterocyclic ring. $M_3$ represents a charge-balancing counterion, and $m_3$ represents a number from 0 to 4 required to neutralize electric charge of a molecule. $R_3$ has the same meaning as R in formula (I). $R_4$ represents an alkyl group, an aryl group, or a heterocyclic group.

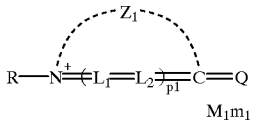

In formulas (I), (III), (IV), and (V), examples of a 5- or 6-membered nitrogen-containing heterocyclic ring represented by $Z_1$, $Z_2$, $Z_3$, $Z_4$, $Z_6$, and $Z_8$ are a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindonine), an imidazoline nucleus, an imidazole nucleus, a benzoimidazole nucleus, a 2-pyridine nucleus, a 4-pyridine nucleus, a 2-quinoline nucleus, a 4-quinoline nucleus, a 1-isoquinoline nucleus, 3-isoquinoline nucleus, an imidazo(4,5-b)quinoxaline nucleus, an oxadiazole nucleus, a thiadiazole nucleus, a tetrazole nucleus, and a pyrimidine nucleus.

Formula (V)

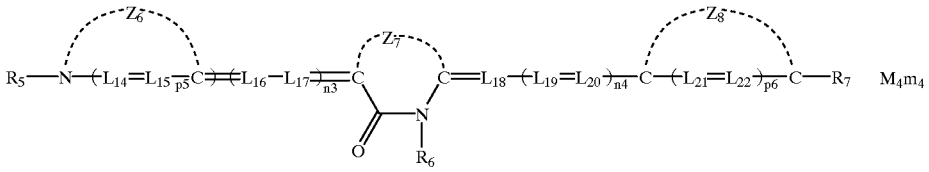

In formula (V), each of $L_{14}$, $L_{15}$, $L_{16}$, $L_{17}$, $L_{18}$, $L_{19}$, $L_{20}$, $L_{21}$, and $L_{22}$ represents a methine group. Each of p5 and p6 represents 0 or 1. Each of n3 and n4 represents 0, 1, 2, or 3. Each of $Z_6$, $Z_7$, and $Z_8$ represents atom groups required to form a 5- or 6-membered nitrogen-containing heterocyclic ring. $M_4$ represents a charge-balancing counterion, and $m_4$ represents a number from 0 to 4 required to neutralize electric charge of a molecule. Each of $R_5$ and $R_7$ represents an alkyl group. Note that at least one of $R_5$ and $R_7$ is a group represented by R in formula (I). $R_6$ represents an alkyl group, an aryl group, or a heterocyclic group.

DETAILED DESCRIPTION OF THE INVENTION

Compounds used in the present invention will be described in detail below.

A compound represented by formula (I) can form any methine dye by using Q. Examples of preferable methine dyes are a cyanine dye, a merocyanine dye, a rhodacyanine dye, a trinuclear merocyanine dye, an allopolar dye, a hemineanine dye, and a styryl dye. Details of these dyes are described in, e.g., F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, paragraph 14, items 482 to 515.

Formulas of a cyanine dye, a merocyanine dye, and a rhodacyanine dye are preferably those indicated by (XI), (XII), and (XIII) on pages 21 and 22 in U.S. Pat. No. 5,340,694.

Formula (I) can also be expressed by the following resonance formula if a cyanine dye is formed by Q.

Preferable examples are a benzoxazole nucleus, a benzothiazole nucleus, a benzoimidazole nucleus, and a quinoline nucleus, and more preferable examples are a benzoxazole nucleus and a benzothiazole nucleus. In formula (III), it is particularly preferable that at least one of $Z_1$ and $Z_2$ be a benzothiazole nucleus and the other be a benzothiazole nucleus or a benzoxazole nucleus.

Assuming a substituent group on $Z_1$, $Z_2$, $Z_3$, $Z_4$, $Z_6$, and $Z_8$ is V, this substituent group represented by V is not particularly limited. Examples are a halogen atom (e.g., chlorine, bromine, iodine, and fluorine), a mercapto group, a cyano group, a carboxyl group, a phosphoric acid group, a sulfo group, a hydroxy group, a carbamoyl group having 1 to 10 carbon atoms, preferably 2 to 8 carbon atoms, and more preferably 2 to 5 carbon atoms (e.g., methylcarbamoyl, ethylcarbamoyl, and morpholinocarbonyl), a sulfamoyl group having 0 to 10 carbon atoms, preferably 2 to 8 carbon atoms, and more preferably 2 to 5 carbon atoms (e.g., methylsulfamoyl, ethylsulfamoyl, and piperidinosulfonyl), a nitro group, an alkoxy group having 1 to 20 carbon atoms, preferably 1 to 10 carbon atoms, and more preferably 1 to 8 carbon atoms (e.g., methoxy, ethoxy, 2-methoxyethoxy, and 2-phenylethoxy), an aryloxy group having 6 to 20 carbon atoms, preferably 6 to 12 carbon atoms, and more preferably 6 to 10 carbon atoms (e.g., phenoxy, p-methylphenoxy, p-chlorophenoxy, and naphthoxy), an acyl group having 1 to 20 carbon atoms, preferably 2 to 12 carbon atoms, and more preferably 2 to 8 carbon atoms (e.g., acetyl, benzoly, and trichloroacetyl), an acyloxy group having 1 to 20 carbon atoms, preferably 2 to 12 carbon atoms, and more preferably 2 to 8 carbon atoms (e.g., acetyloxy and benzoyloxy), an acylamino group having 1 to 20 carbon atoms, preferably 2 to 12 carbon atoms, and more preferably 2 to 8 carbon atoms (e.g., acetylamino), a sulfonyl group having 1 to 20 carbon atoms, preferably 1 to 10 carbon atoms, and more preferably 1 to 8 carbon atoms (e.g., methanesulfonyl, ethanesulfonyl, and benzenesulfonyl), a sulfinyl group having 1 to 20 carbon atoms, preferably 1 to 10 carbon atoms, and more preferably 1 to 8 carbon atoms (e.g., methanesulfinyl and benzenesulfinyl), a sulfonylamino group having 1 to 20 carbon atoms, preferably 1 to 10 carbon atoms, and more preferably 1 to 8 carbon atoms (e.g., methanesulfonylamino, ethanesulfonylamino, and benzenesulfonylamino), an amino group, a substituted amino group having 1 to 20 carbon atoms, preferably 1 to 12 carbon atoms, and more preferably 1 to 8 carbon atoms (e.g., methylamino, dimethylamino, benzylamino, anilino, and diphenylamino), an ammonium group having 0 to 15 carbon atoms, preferably 3 to 10 carbon atoms, and more preferably 3 to 6 carbon atoms (e.g., trimethylammonium and triethylammonium), a hydrazino group having 0 to 15 carbon atoms, preferably 1 to 10 carbon atoms, and more preferably 1 to 6 carbon atoms (e.g., trimethylhydrazino), a ureido group having 1 to 15 carbon atoms, preferably 1 to 10 carbon atoms, and more preferably 1 to 6 carbon atoms (e.g., ureido and N,N-dimethylureido), an imide group having 1 to 15 carbon atoms, preferably 1 to 10 carbon atoms, and more preferably 1 to 6 carbon atoms (e.g., succinimide), an alkylthio or arylthio group having 1 to 20 carbon atoms, preferably 1 to 12 carbon atoms, and more preferably 1 to 8 carbon atoms (e.g., methylthio, ethylthio, carboxyethylthio, sulfobutylthio, and phenylthio), an alkoxycarbonyl group having 2 to 20 carbon atoms, preferably 2 to 12 carbon atoms, and more preferably 2 to 8 carbon atoms (e.g., methoxycarbonyl, ethoxycarbonyl, and benzyloxycarbonyl), an aryloxycarbonyl group having 6 to 20 carbon atoms, preferably 6 to 12 carbon atoms, and more preferably 6 to 8 carbon atoms (e.g., phenoxycarbonyl), a nonsubstituted alkyl group having 1 to 18 carbon atoms, preferably 1 to 10 carbon atoms, and more preferably 1 to 5 carbon atoms (e.g., methyl, ethyl, propyl, and butyl), a substituted alkyl group having 1 to 18 carbon atoms, preferably 1 to 10 carbon atoms, and more preferably 1 to 5 carbon atoms (e.g., hydroxymethyl, trifluoromethyl, benzyl, carboxylethyl, ethoxycarbonylmethyl, and acetylaminomethyl; assume that this substituted alkyl group also includes an unsaturated hydrocarbon group having 2 to 18 carbon atoms, preferably 3 to 10 carbon atoms, and more preferably 3 to 5 carbon atoms (e.g., vinyl, ethynyl, 1-cyclohexenyl, benzylidyne, and benzylidene)), a substituted or nonsubstituted aryl group having 6 to 20 carbon atoms, preferably 6 to 15 carbon atoms, and more preferably 6 to 10 carbon atoms (e.g., phenyl, naphthyl, p-carboxyphenyl, p-nitrophenyl, 3,5-dichlorophenyl, p-cyanophenyl, m-fluorophenyl, and p-tolyl), and a heterocyclic group which has 1 to 20 carbon atoms, preferably 2 to 10 carbon atoms, and more preferably 4 to 6 carbon atoms and can be substituted (e.g., pyridyl, 5-methylpyridyl, thienyl, furyl, morpholino, and tetrahydrofurfuryl). The substituent group can also take the condensed structure of a benzene ring or a naphthalene ring.

V can be further substituted on these substituent groups.

The substituent groups on $Z_1$, $Z_2$, $Z_3$, $Z_4$, $Z_6$, and $Z_8$ are preferably an alkyl group, an aryl group, an alkoxy group, a halogen atom, an acyl group, a cyano group, a sulfonyl group, and benzene ring condensation, more preferably an alkyl group, an aryl group, a halogen atom, an acyl group, a sulfonyl group, and benzene ring condensation, and particularly preferably methyl, phenyl, methoxy, a chlorine atom, a bromine atom, an iodine atom, and benzene ring condensation. The substituent groups are most preferably phenyl, a chlorine atom, a bromine atom, and an iodine atom.

Each of $R_1$, $R_2$, $R_3$, $R_5$, and $R_7$ in formulas (III), (IV), and (V) represents an alkyl group. Examples of an alkyl group represented by $R_1$ and $R_2$ are a nonsubstituted alkyl group having 1 to 18, preferably 1 to 7, and particularly preferably 1 to 4 carbon atoms (e.g., methyl, ethyl, propyl, isopropyl, butyl, isobutyl, hexyl, octyl, dodecyl, and octadecyl), and a substituted alkyl group having 1 to 18, preferably 1 to 7, and particularly preferably 1 to 4 carbon atoms {e.g., a heterocyclic group substituted by V which is enumerated as a substituent group for $Z_1$ described above; preferable examples are an aralkyl group (e.g., benzyl and 2-phenylethyl), an unsaturated hydrocarbon group (e.g., allyl), a hydroxyalkyl group (e.g., 2-hydroxyethyl and 3-hydroxylpropyl), a carboxyalkyl group (e.g., 2-carboxyethyl, 3-carboxypropyl, 4-carboxybutyl, and carboxymethyl), an alkoxyalkyl group (e.g., 2-methoxyethyl and 2-(2-methoxyethoxy)ethyl), an aryloxyalkyl group (e.g., 2-phenoxyethyl and 2-(1-naphthoxy)ethyl), an alkoxycarbonylalkyl group (e.g., ethoxycarbonylmethyl and 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 3-sulfo-2-methylpropyl, 3-sulfopentyl, 3-sulfo-3-phenylpropyl, 2-(3-sulfopropoxy)ethyl, 2-hydroxy-3-sulfopropyl, and 3-sulfopropoxyethoxyethyl), a sulfoalkenyl group (e.g., 3-sulfo-2-propenyl), a sulfoaralkyl group (e.g., 2-sulfobenzyl), a sulfatoalkyl group (e.g., 2-sulfatoethyl, 3-sulfatopropyl, and 4-sulfatobutyl), a heterocyclic ring-substituted alkyl group (e.g., 2-(pyridine-2-one-1-yl)ethyl and tetrahydrofurfuryl), and a group (e.g., methanesulfonylcarbamoylmethyl) represented by R in formula (I)}.

Alkyl groups represented by $R_1$, $R_2$, $R_3$, $R_5$, and $R_7$ are preferably a carboxylalkyl group, a sulfoalkyl group, a sulfoalkenyl group, a sulfoaralkyl group, a sulfatoalkyl group, and R, and more preferably a sulfoalkyl group, a sulfoalkenyl group, and R.

$Z_5$ represents atom groups required to form an acidic nucleus and can take the form of an acidic nucleus of any general merocyanine dye. An acidic nucleus herein mentioned is defined in James ed., "The Theory of the Photographic Process", the 4th ed., Macmillan, 1977, page 198. Practical examples are described in U.S. Pat. Nos. 3,567,719, 3,575,869, 3,804,634, 3,837,862, 4,002,480, and 4,925,777, and JP-A-3-167546 ("JP-A" means Published Unexamined Japanese Patent Application).

An acidic nucleus preferably forms a 5- or 6-membered nitrogen-containing heterocyclic ring consisting of carbon, nitrogen, and chalcogen (typically oxygen, sulfur, selenium, and tellurium) atoms, and examples are the following nuclei.

Nuclei of 2-pyrazoline-5-one, pyrazolidine-3,5-dione, imidazoline-5-one, hydantoin, 2- or 4-thiohydantoin, 2-iminoxazolidine-4-one, 2-oxazoline-5-one, 2-thioxazoline-2,4-dione, isoxazoline-5-one, 2-thiazoline-4-one, thiazolidine-4-one, thiazolidine-2,4-dione, rhodanine, thiazolidine-2,4-dithione, isorhotanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo(3,2-a)pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido(1,2-a)pyrimidine-1,3-dione, pyrazolo(1,5-b)quinazolone, pyrazolo(1,5-a) benzoimidazole, pyrazolopyridone, 1,2,3,4-tetrahydroquinoline-2,4-dione, 3-oxo-2,3-dihydrobenzo(d) thiophene-1,1-dioxide, and 3-dicyanomethine-2,3-dihydrobenzo(d)thiophene-1,1-dioxide.

$Z_5$ is preferably hydantoin, 2- or 4-thiohydantoin, 2-oxazoline-5-one, 2-thioxazoline-2,4-dione, thiazolidine-2,4-dione, rhodanine, thiazolidine-2,4-dithione, barbituric acid, or 2-thiobarbituric acid, more preferably hydantoin, 2- or 4-thiohydantoin, 2-oxazoline-5-one, rhodanine, barbituric acid, or 2-thiobarbituric acid, and particularly preferably 2- or 4-thiohydantoin, 2-oxazoline-5-one, or rhodanine.

A 5- or 6-membered nitrogen-containing heterocyclic ring formed by $Z_7$ is a compound formed by removing an oxo group or a thioxo group from a heterocyclic ring represented by $Z_5$. $Z_7$ is preferably a compound formed by removing an oxo group or a thioxo group from hydantoin, 2- or 4-thiohydantoin, 2-oxazoline-5-one, 2-thioxazoline-2,4-dione, thiazolidine-2,4-dione, rhodanine, thiazolidine-2,4-dione, barbituric acid, or 2-thiobarbituric acid, more preferably a compound formed by removing an oxo group or a thioxo group from hydantoin, 2- or 4-thiohydantoin, 2-oxazoline-5-one, rhodanine, barbituric acid, or 2-thiobarbituric acid, and particularly preferably a compound formed by removing an oxo group or a thioxo group from 2- or 4-thiohydantoin, 2-oxazoline-5-one, or rhodanine.

Examples of an alkyl group represented by $R_4$ and $R_6$ are a nonsubstituted alkyl group and a substituted alkyl group enumerated as examples of $R_1$ described above, and similar compounds are preferable. Examples are a nonsubstituted aryl group having 6 to 20 carbon atoms, preferably 6 to 10 carbon atoms, and more preferably 6 to 8 carbon atoms (e.g., phenyl and 1-naphthyl), a substituted aryl group having 6 to 20 carbon atoms, preferably 6 to 10 carbon atoms, and more preferably 6 to 8 carbon atoms (e.g., an aryl group substituted by V which is enumerated as a substituent group for $Z_1$ described above; practical examples are a p-methoxyphenyl, p-methylphenyl, and p-chlorophenyl), a nonsubstituted heterocyclic group having 1 to 20 carbon atoms, preferably 3 to 10 carbon atoms, and more preferably 4 to 8 carbon atoms (e.g., 2-furyl, 2-thienyl, 2-pyridyl, 3-pyrazolyl, 3-isoxazolyl, 3-isothiazolyl, 2-imidazolyl, 2-oxazolyl, 2-thiazolyl, 2-pyridazyl, 2-pyrimidyl, 3-pyridyl, 2-(1,3,5-triazolyl), 3-(1,2,4-triazolyl), and 5-tetrazolyl), and a substituted heterocyclic group having 1 to 20 carbon atoms, preferably 3 to 10 carbon atoms, and more preferably 4 to 8 carbon atoms (e.g., a heterocyclic group substituted by V which is enumerated as a substituent group for $Z_1$ described above; practical examples are a 5-methyl-2-thienyl and 4-methoxy-2-pyridyl).

$R_4$ and $R_6$ are preferably methyl, ethyl, 2-sulfoethyl, 3-sulfopropyl, 3-sulfobutyl, 4-sulfobutyl, carboxymethyl, phenyl, 2-pyridyl, and 2-thiazolyl, and more preferably ethyl, 2-sulfoethyl, carboxymethyl, phenyl, and 2-pyridyl.

R in formula (I) will be described below.

Each of $Q_a$, $Q_b$, $Q_c$, and $Q_d$ is a nonsubstituted methylene group or a substituted methylene group (e.g., a methylene group substituted by V described above; practical examples are a methyl-substituted methylene, an ethyl-substituted methylene, a phenyl-substituted methylene, a hydroxy-substituted methylene, and a halogen atom (e.g., a chlorine atom or a bromine atom)-substituted methylene group), and preferably a nonsubstituted methylene group.

Each of $R_a$, $R_b$, $R_c$, and $R_d$ represents an alkyl group, an aryl group, a heterocyclic group, an alkoxy group, an aryloxy group, or an amino group. An alkyl group, an aryl group, and a heterocyclic group are preferably similar to those enumerated for $R_4$ and $R_6$ described above. An example of an alkoxy group is an alkoxy group having 1 to 20 carbon atoms, preferably 1 to 10 carbon atoms, and more preferably 1 to 8 carbon atoms (e.g., methoxy, ethoxy, 2-methoxyethoxy, and 2-hydroxyethoxy), an example of an aryloxy group is an aryloxy group having 6 to 20 carbon atoms, preferably 6 to 12 carbon atoms, and more preferably 6 to 10 carbon atoms (e.g., phenoxy, p-methylphenoxy, p-chlorophenoxy, and naphthoxy), and an example of an amino group is an amino group having 0 to 20 carbon atoms, preferably 0 to 12 carbon atoms, and more preferably 0 to 8 carbon atoms (e.g., amino, methylamino, dimethylamino, ethylamino, hydroxyethylamino, benzylamino, anilino, diphenylamino, morpholino formed in a ring, and pyrrolidino). These substituent groups can be further substituted by V described previously. The substituent group is more preferably methyl, ethyl, or hydroxyethyl, and particularly preferably methyl.

Each of r, t, s, and u represents an integer from 0 to 10, preferably 1, 2, 3, 4, or 5, more preferably 1, 2, or 3, and particularly preferably 1. If r, t, s, and u are 2 or more, methylene groups are repeated but they need not be identical.

Note that all Rs in the present invention are expressed in dissociated forms, but they can also take an undissociated form as represented by R' below.

R' =

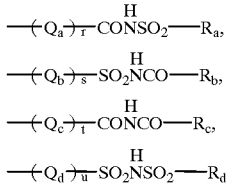

In practical examples of dyes of the present invention, the combination of R and a charge-balancing counterion ($H^+$) is used as a method of expressing R' as follows.

R' =

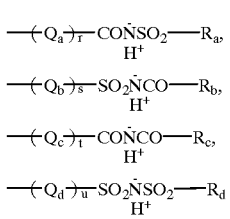

Whether a dye of the present invention is R or R' in a silver halide light-sensitive material depends upon the pH of the sensitive material.

Practical examples of R in formula (I) are presented below.

| R (dissociated) | R' (undissociated) |
|---|---|
| $-(CH_2)_3CO\bar{N}-SO_2CH_3$ | $-(CH_2)_3CONHSO_2CH_3$ |
| $-(CH_2)_2CO\bar{N}-SO_2CH_3$ | $-(CH_2)_2CONHSO_2CH_3$ |
| $-CH_2-CO\bar{N}SO_2CH_3$ | $-CH_2CONHSO_2CH_3$ |
| $-(CH_2)_4SO_2\bar{N}-COCH_3$ | $-(CH_2)_4SO_2NHCOCH_3$ |
| $-(CH_2)_3SO_2\bar{N}-COCH_3$ | $-(CH_2)_3SO_2NHCOCH_3$ |
| $-(CH_2)_2SO_2\bar{N}-COCH_3$ | $-(CH_2)_2SO_2NHCOCH_3$ |
| $-CH_2-SO_2\bar{N}-COCH_3$<br>$-CH_2CO\bar{N}-SO_2C_2H_5$ | $-CH_2-SO_2NHCOCH_3$<br>$-CH_2CONHSO_2C_2H_5$ |
| $-CH_2CO\bar{N}-SO_2N(CH_3)_2$ | $-CH_2CONHSO_2N(CH_3)_2$ |

Each of $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, and $L_{22}$ independently represents a methine group. A methine group represented by $L_1$ to $L_{22}$ can have a substituent group. Examples of the substituent group are a substituted or nonsubstituted alkyl group having 1 to 15 carbon atoms, preferably 1 to 10 carbon atoms, and more preferably 1 to 5 carbon atoms (e.g., methyl, ethyl, and 2-carboxyethyl), a substituted or nonsubstituted aryl group having 6 to 20 carbon atoms, preferably 6 to 15 carbon atoms, and more preferably 6 to 10 carbon atoms (e.g., phenyl and o-carboxyphenyl), a substituted or nonsubstituted heterocyclic group having 3 to 20 carbon atoms, preferably 4 to 15 carbon atoms, and more preferably 6 to 10 carbon atoms (e.g., an N,N-diethylbarbituric acid group), a halogen atom (e.g., chlorine, bromine, fluorine, and iodine), an alkoxy group having 1 to 15 carbon atoms, preferably 1 to 10 carbon atoms, and more preferably 1 to 5 carbon atoms (e.g., methoxy and ethoxy), an alkylthio group having 1 to 15 carbon atoms, preferably 1 to 10 carbon atoms, and more preferably 1 to 5 carbon atoms (e.g., methylthio and ethylthio), an arylthio group having 6 to 20 carbon atoms, preferably 6 to 15 carbon atoms, and more preferably 6 to 10 carbon atoms (e.g., phenylthio), and an amino group having 0 to 15 carbon atoms, preferably 2 to 10 carbon atoms, and more preferably 4 to 10 carbon atoms (e.g., N,N-diphenylamino, N-methyl-N-phenylamino, and N-methylpiperazino). These methine groups may be bonded to another methine group to form a ring or can also form a ring having an auxochrome.

Each of n1, n2, and n3 is preferably 0 or 1, and more preferably 1. n4 is preferably 0 or 1, and more preferably 0. If n1, n2, n3, and n4 are 2 or more, methine groups are repeated but they need not be identical.

When required to neutralize the ion charge of a dye, $M_1$, $M_2$, $M_3$, and $M_4$ are included in a formula to indicate the existence of a cation or an anion. Typical examples of the cation are inorganic cations such as a hydrogen ion ($H^+$), an alkali metal ion (e.g., a sodium ion, a potassium ion, and a lithium ion), and an alkali earth metal ion (e.g., a calcium ion), and organic ions such as an ammonium ion (e.g., an ammonium ion, a tetraalkylammonium ion, a pyridinium ion, and an ethylpyridinium ion). The anion can be either an inorganic anion or an organic anion. Examples are a halogen anion (e.g., a fluorine ion, a chlorine ion, and an iodine ion), a substituted arylsulfonic acid ion (e.g., a p-toluenesulfonic acid ion and a p-chlorobenzenesulfonic acid ion), an aryldisulfonic acid ion (e.g., a 1,3-benzenesulfonic acid ion, a 1,5-naphthalenedisulfonic acid ion, and a 2,6-naphthalenedisulfonic acid ion), an alkyl sulfuric acid ion (e.g., a methyl sulfuric acid ion), a sulfuric acid ion, a thiocyanic acid ion, a perchloric acid ion, a tetrafluoroboric acid ion, a picric acid ion, an acetic acid ion, and a trifluoromethanesulfonic acid ion. It is also possible to use an ionic polymer or another dye having the opposite electric charge against a dye.

Each of $m_1$, $m_2$, $m_3$, and $m_4$ represents a number necessary to balance the electric charge and is 0 if inner salt is formed.

Each of p1, p2, p3, p4, p5, and p6 independently represents 0 or 1 and is preferably 0.

Of formulas (III), (IV), and (V), formula (III) is most preferred. In formula (III), it is preferable that n1 be 1 and each of $Z_2$ and $Z_3$ be a benzoxazole nucleus or a benzothiazole nucleus. It is further preferable that $R_1$ be R in formula (I) and $R_2$ be a sulfoalkyl group, a sulfoalkenyl group, or a sulfoaralkyl group.

Practical examples of compounds represented by formula (I) (including formulas (III), (IV), and (V) as the lower conceptions) of the present invention are presented below. However, the present invention is not limited to these examples.

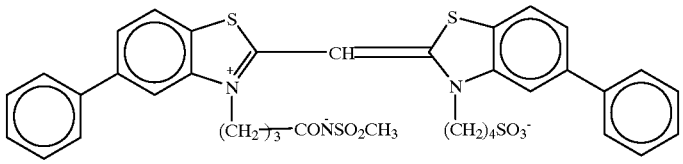

(1) $n = 1$ (2) $n = 2$ (3) $n = 3$

-continued
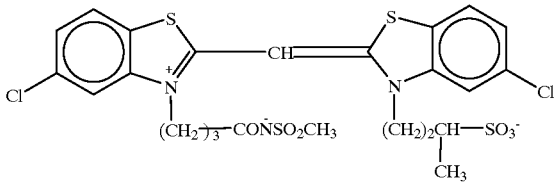
$H^+$
(4) $n = 1$ (5) $n = 2$ (6) $n = 3$
(7)
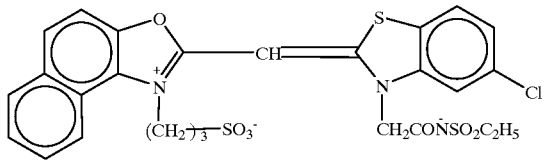
$Na^+$
(8)
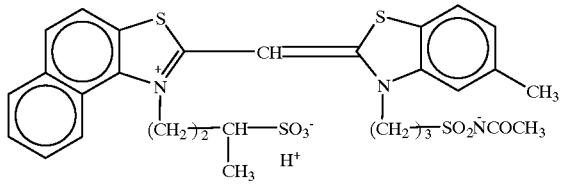
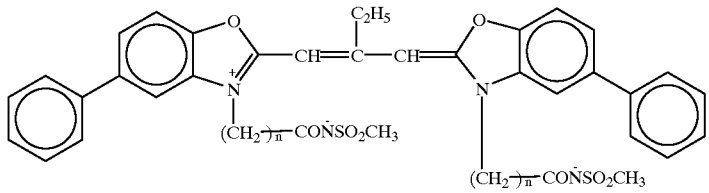
$H^+$
(9) $n = 1$ (10) $n = 3$
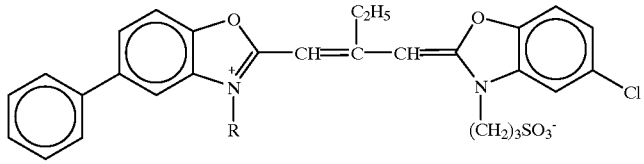
$H^+$
(11) R = $(CH_2)_3CO\bar{N}SO_2CH_3$ (12) R = $(CH_2)_3SO_2\bar{N}COCH_3$
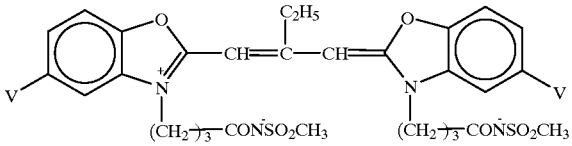
$H^+$
(13) V = Br (14) V = I
(15)
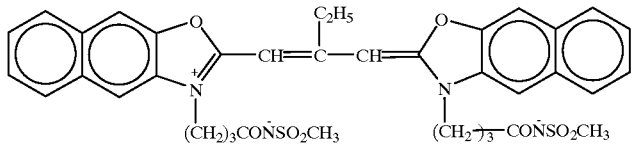
$H^+$ -continued
(16)
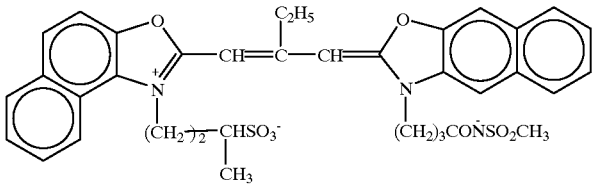
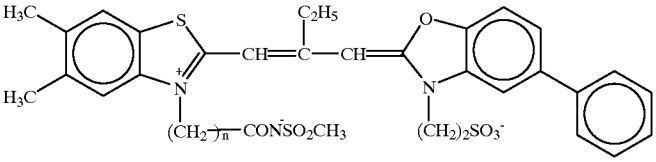
$H^+$
(17) $n = 1$ (18) $n = 2$ (19) $n = 3$
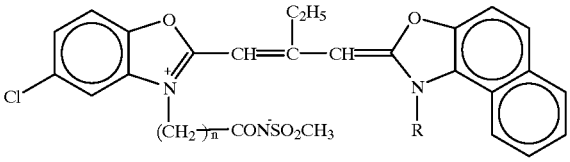
$H^+$
(20) $n = 1$, R = $(CH_2)_3SO_3^-$
(21) $n = 2$, R = $(CH_2)_2CH(CH_3)SO_3^-$
(22) $n = 2$, R = $CH_2CH{=}CHSO_3^-$
(23) $n = 1$, R = $(CH_2)_2OSO_3^-$
(24) $n = 1$, R = $CH_2CH(CH_3)CH_2SO_3^-$
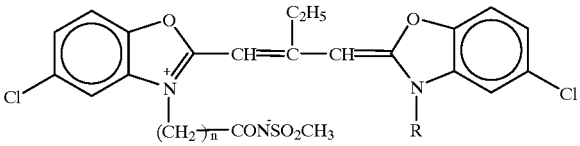
$H^+$
(25) $n = 1$, R = $(CH_2)_4SO_3^-$
(26) $n = 1$, R = $(CH_2)_2CH(CH_3)SO_3^-$
(27) $n = 1$, R = $(CH_2)_2CH(CH_3)SO_3^-$
(28) $n = 2$, R = $(CH_2)_2CH(C_6H_5)SO_3^-$
(29)
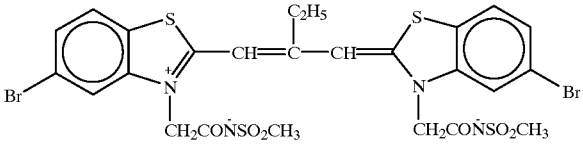
$H^+$ -continued
(30)
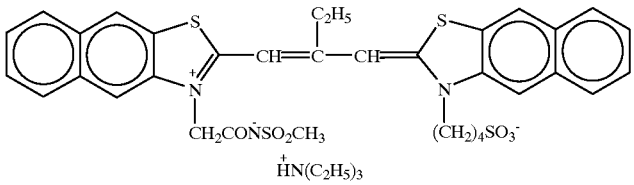
(31)
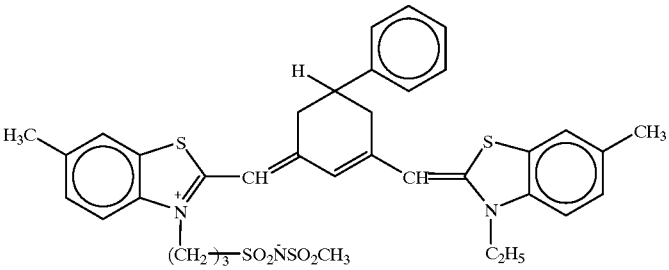
(32)
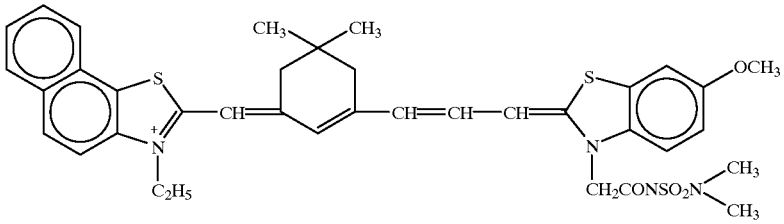
(33)
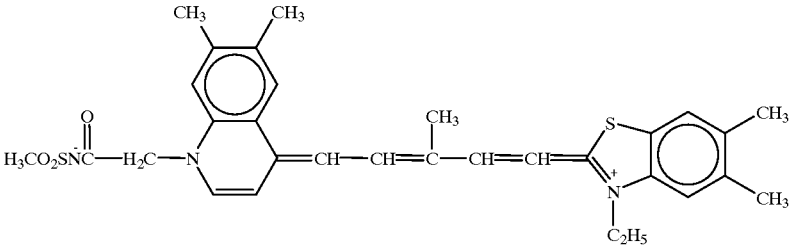
(34)
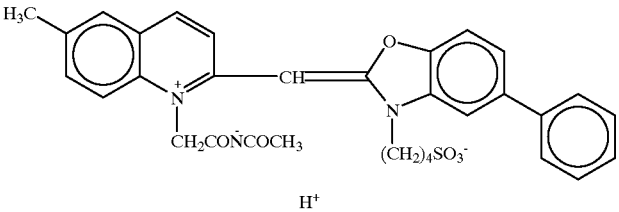
(35)
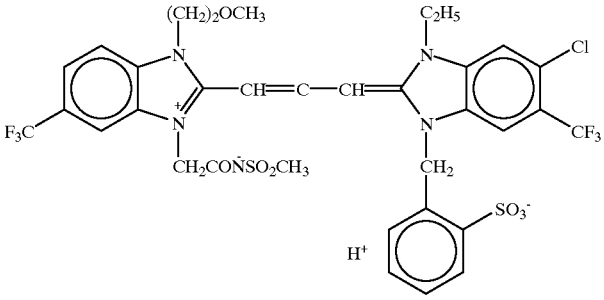

-continued
(36)
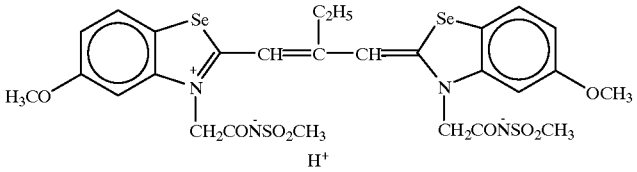
(37)
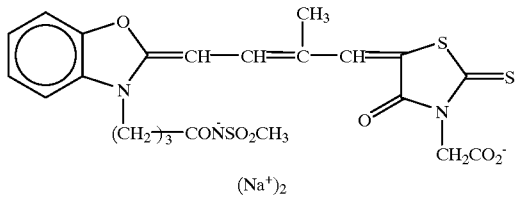
(38)
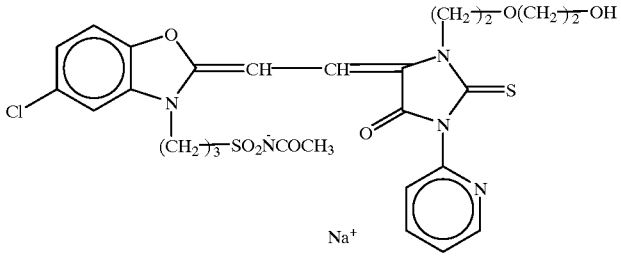
(39)
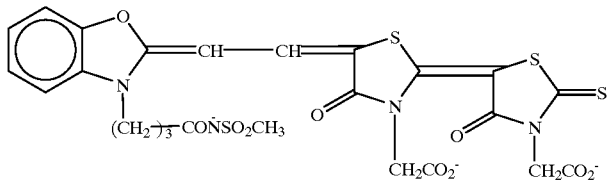
(40)
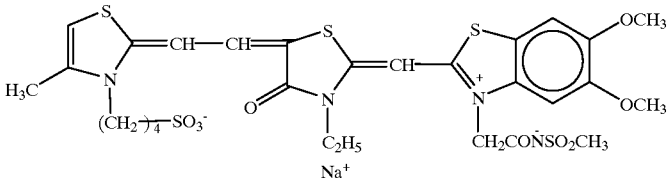
(41)
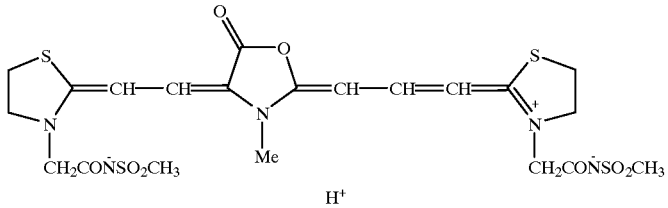
(42)
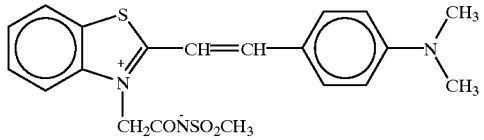

-continued (43)

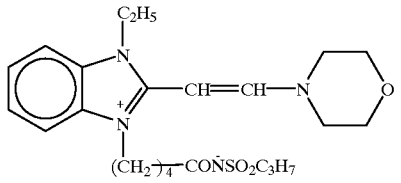

Compounds represented by formula (I) (formula (I) includes formulas (III), (IV), and (V) as the lower conceptions) of the present invention can be synthesized on the basis of methods described in, e.g., F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, paragraph 14, items 482 to 515, John Wiley & Sons, New York, London, 1977, "Rodd's Chemistry of Carbon Compounds", 2nd. Ed., vol. IV, part B, 1977, chapter 15, items 369 to 422, Elsevier Science Publishing Company Inc., New York, and British Patent 1,077,611.

Synthesis example (synthesis of compound (20))

Compound (20) can be synthesized in accordance with the scheme presented below.

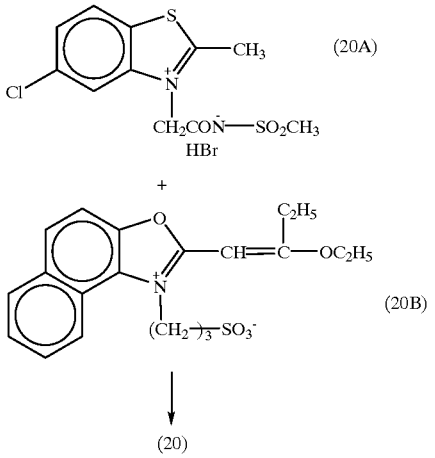

2 g (5 mmol) of (20A), 3.31 g (8.5 mmol) of (20B), 8 ml of dimethylsulfoxide, and 1.66 g (11 mmol) of 1,8-diazabicyclo(5,4,0)-7-undecene were stirred at room temperature for 1 hour, and then 10 ml of ethyl acetate was added. The supernatant liquid was removed by decantation, the residue was dissolved by adding 20 ml of methanol, and the solution was purified through a cephadex column. (Eluting solution methanol). After the resultant crystal was dissolved by adding 20 ml of methanol, 1 ml of acetic acid was added to the solution, and the precipitated crystal was extracted by suction filtration and dried. The result was 0.36 g of reddish purple crystal (yield 10.9%, λmax=536 nm (E=106000) (in MeOH) a melting point: decomposed at 200° C. or more).

The addition amount of a spectral sensitizing dye represented by formula (I) is preferably $0.5\times10^{-6}$ mol to $1.0\times10^{-2}$ mol per mol of silver halide. The addition amount is more preferably $1.0\times10^{-5}$ mol to $5.0\times10^{-3}$ mol.

Sensitizing dyes can be added in the step of forming silver halide grains, in the step of chemical sensitization, or when coating is performed.

As a method of adding sensitizing dyes during the formation of silver halide emulsion grains, U.S. Pat. Nos. 4,225,666 and 4,828,972 and JP-A-61-103149 can be referred to. As a method of adding sensitizing dyes in the step of desalting a silver halide emulsion, European Patent 291,339-A and JP-A-64-52137 can be referred to. Also, JP-A-59-48756 can be referred to as a method of adding sensitizing dyes in the step of chemical sensitization.

As a method of raising the spectral sensitization sensitivity by using sensitizing dyes, a method which uses a combination of two or more sensitizing dyes is known. When two or more sensitizing dyes are combined, the spectral sensitivity often achieves the effect which is intermediate between the effects when the individual sensitizing dyes are singly used, or decreases. However, when a certain specific combination of sensitizing dyes is used, the spectral sensitivity sometimes significantly rises compared to cases where the individual sensitizing dyes are singly used. This phenomenon is usually called a supersensitization action of sensitizing dyes. The supersensitization action is summarized in T. H. James ed., "The Theory of the Photographic Process", the 4th ed., Macmillan, New York, 1977, chapter 10 (by W. West and P. B. Gilman).

When such a combination of sensitizing dyes is used, the spectral sensitization wavelength sometimes becomes the intermediate between the spectral sensitization wavelengths when the individual sensitizing dyes are singly used, or forms a simple bond. However, the spectral sensitization sometimes transits to a wavelength unpredictable from the spectral sensitization characteristics when these sensitizing dyes are singly used.

It is an important object in the techniques of spectrally sensitizing silver halide photographic emulsions to use a combination of sensitizing dyes as described above to thereby obtain a higher sensitivity than when the individual sensitizing dyes are singly used, and to find out a combination of sensitizing dyes having a sensitization wavelength region meeting the intended use of a photographic light-sensitive material.

In a combination of sensitizing dyes used to obtain supersensitization, a significant selectivity is required between the dyes, and an apparently slight difference between the chemical structures has a significant effect on the supersensitization action. That is, a combination of sensitizing dyes by which the supersensitization action is obtained is difficult to predict simply from chemical structures.

As supersensitizers, it is possible to use dyes having no spectral sensitization action itself or substances which do not essentially absorb visible light. Examples are anomistyryl compounds substituted by a nitrogen-containing heterocyclic group (e.g., compounds described in U.S. Pat. Nos. 2.933,390 and 3,635,721), aromatic organic acid formaldehyde condensates (e.g., condensates described in U.S. Pat. No. 3,743,510), cadmium salt, and an azaindene compound. Combinations described in U.S. Pat. Nos. 3,615,613, 3,615,641, 3,617,295, and 3,635,721 are particularly useful.

The process of preparing a silver halide emulsion is roughly divided into steps of grain formation, desalting, and chemical sensitization. The grain formation step is subdivided into nucleation, ripening, and growth. These steps are not performed in a predetermined order, i.e., they are performed in a reverse order or repeatedly. Performing reduction sensitization used in the present invention during the preparation of a silver halide emulsion means that the reduction sensitization can be basically performed in any of these steps. That is, the reduction sensitization can be performed during nucleation or physical ripening, as the initial stages of the grain formation, during growth, or prior to or after chemical sensitization. If chemical sensitization is to be performed in combination with gold sensitization, the reduction sensitization is preferably performed before the chemical sensitization so that an undesired fog is not produced. Most preferably, the reduction sensitization is performed during the growth of silver halide grains. This method of performing reduction sensitization during the growth includes a method of performing reduction sensitization while silver halide grains are being physically ripened or being grown upon addition of a water-soluble silver salt and a water-soluble alkali halide, and a method of performing reduction sensitization while temporarily stopping the growth and then performing the growth again.

Known methods of the reduction sensitization used in the present invention are a method of adding well-known reduction sensitizers to a silver halide emulsion, a method called silver ripening in which grains are grown or ripened in a low-pAg circumstance at pAg 1 to 7, and a method called high-pH ripening in which grains are grown or ripened in a high-pH circumstance at pH 8 to 11. Two or more of these methods can be used together.

The method of adding reduction sensitizers is preferable in that the level of reduction sensitization can be finely adjusted.

Known examples of the reduction sensitizer are stannous chloride, amine and polyamic acid, a hydrazine derivative, formamidinesulfinic acid, a silane compound, and a borane compound. In the present invention, these known compounds can be selectively used. Also, two or more compounds can be used together. A compound used as the reduction sensitizer is preferably stannous chloride, thiourea dioxide, dimethylamineborane, or an alkinylamine compound described in U.S. Pat. No. 5,389,510, and more preferably thiourea dioxide. Although the addition amount of the reduction sensitizers depends upon the emulsion preparing conditions and must be so selected, the amount is $10^{-7}$ to $10^{-3}$ mol per mol of silver halide.

As the reduction sensitizers of the present invention, ascorbic acid and its derivatives can also be used.

Practical examples of ascorbic acid and its derivatives (to be referred to as "sulcorbic acid compounds" hereinafter) are as follows.

| | |
|---|---|
| (A-1) | L-ascorbic acid |
| (A-2) | L-ascorbic acid sodium |
| (A-3) | L-ascorbic acid potassium |
| (A-4) | DL-ascorbic acid |
| (A-5) | D-ascorbic acid sodium |
| (A-6) | L-ascorbic acid-6-acetate |
| (A-7) | L-ascorbic acid-6-balmitate |
| (A-8) | L-ascorbic acid-6-benzoate |
| (A-9) | L-ascorbic acid-5,6-diacetate |
| (A-10) | L-ascorbic acid-5,6-O-isopropyridene |

It is desirable that the ascorbic acid compound used in the present invention be used in an amount larger than the addition amount conventionally used for reduction sensitizers. For example, JP-B-57-33572 describes "The amount of a reducing agent does not usually exceed $0.75\times10^{-2}$ milliequivalent amount ($8\times10^{-4}$ mol/Ag×mol) per g of silver ion. An amount of 0.1 to 10 mg per kg of silver nitrate ($10^{-7}$ to $10^{-5}$ mol/Ag×mol as an amount of ascorbic acid) is effective in many instances." (the converted values are calculated by the present inventors). U.S. Pat. No. 2,487,850 describes "an addition amount by which a tin compound can be used as a reduction sensitizer is $1\times10^{-7}$ to $44\times10^{-6}$ mol". JP-A-57-179835 describes that a proper addition amount of thiourea dioxide is about 0.01 mg to about 2 mg per mol of silver halide and a proper addition amount of stannous chloride is about 0.01 mg to about 3 mg. A preferable addition amount of the ascorbic acid compound used in the present invention depends upon factors such as the grain size of an emulsion, the halogen composition, and the temperature, pH, and pAg of emulsion preparation. However, the addition amount is selected from preferably $5\times10^{-5}$ to $1\times10^{-1}$ mol, more preferably $5\times10^{-4}$ to $1\times10^{-2}$ mol, and particularly preferably $1\times10^{-3}$ to $1\times10^{-4}$ mol per mol of silver halide. Thiourea dioxide is particularly preferable among these reduction sensitizers.

It is possible to dissolve the reduction sensitizers in water or a solvent such as alcohols, glycols, ketones, esters, or amides, and add the resultant solution during grain formation or before or after chemical sensitization. Reduction sensitizers can be added in any step of the emulsion preparation, but it is particularly preferable to add reduction sensitizers during grain growth. Although adding to a reactor vessel in advance is also preferable, adding at a given timing during grain formation is more preferable. It is also possible to add the reduction sensitizers to an aqueous solution of a water-soluble silver salt or a water-soluble alkali halide to form grains by using this aqueous solution. Alternatively, a method by which a solution of the reduction sensitizers is added separately several times or continuously over a long time period with the progress of grain growth is also preferable.

It is preferable to use an oxidizer for silver during the process of preparing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver can be either an inorganic organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound {e.g., $K_2(Ti(O_2)C_2O_4).3H_2O$, $4K_2SO_4.Ti(O_2)OH.SO_4.2H_2O$, and $Na_3(VO(O_2)(C_2H_4)_2).6H_2O$}, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate. Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

A disulfide compound described in European Patent 0627657A2 is used as a more preferable oxidizer.

Preferable oxidizers of the present invention are ozone, hydrogen peroxide and its adduct, a halogen element, an inorganic oxidizer of thiosulfonate, and an organic oxidizer of quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

A silver halide photographic light-sensitive material of the present invention preferably contains at least one compound selected from compounds represented by formulas (XX), (XXI), and (XXII) below.

Formula (XX) $R_{101}$—$SO_2S$-$M_{101}$

Formula (XXI) $R_{101}$—$SO_2S$—$R_{102}$

Formula (XXII) $R_{101}$—$SO_2S$-$(E)_a$-$SSO_2$—$R_{103}$ wherein each of $R_{101}$, $R_{102}$, and $R_{103}$ represents an aliphatic group, an aromatic group, or a heterocyclic group, $M_{101}$ represents a cation, E represents a divalent linking group, and a represents 0 or 1.

A compound of formula (XX), (XXI), of (XXII) will be described in more detail below. If each of $R_{101}$, $R_{102}$, and $R_{103}$ is an aliphatic group, this aliphatic group is preferably an alkyl group having 1 to 22 carbon atoms or an alkenyl or alkinyl group having 2 to 22 carbon atoms, and these groups can have a substituent group. Examples of an alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of an alkenyl group are allyl and butenyl.

Examples of an alkinyl group are propagyl and butynyl.

An aromatic group of $R_{101}$, $R_{102}$, and $R_{103}$ preferably has 6 to 20 carbon atoms, and a phenyl and a naphthyl are examples. These groups can be substituted.

A heterocyclic group of $R_{101}$, $R_{102}$, and $R_{103}$ is a 3- to 15-membered ring having at least one element selected from nitrogen, oxygen, sulfur, selenium, and tellurium. Examples are a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tellurazole ring, a triazole ring, a benzotriazole ring, a tetrazole ring, an oxadiazole ring, and a thiadiazole ring.

Examples of a substituent group of $R_{101}$, $R_{102}$, and $R_{103}$ are an alkyl group (e.g., methyl, ethyl, and hexyl), an alkoxy group (e.g., methoxy, ethoxy, and octyloxy), an aryl group (phenyl, naphthyl, and tolyl), a hydroxy group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and varelyl), a sulfonyl group (e.g., methylsulfonyl and phenylsulfonyl), an acylamino group (e.g., acetylamino and benzamino), a sulfonylamino group (e.g., methanesulfonylamino and benzenesulfonylamino), an acyloxy group (e.g., acetoxy and benzoxy), a carboxyl group, a cyano group, a sulfo group, and an amino group.

E is preferably a divalent aliphatic group or a divalent aromatic group. Examples of a divalent aliphatic group of E are —$(CH_2)_n$— (n=1 to 12), —$CH_2$—CH=CH—$CH_2$—,

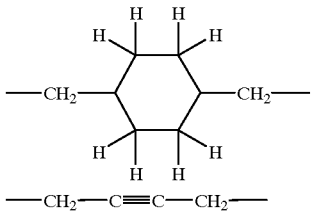

and a xylylene. Examples of a divalent aromatic group of E are phenylene and naphthylene.

These substituent groups can be further substituted by the substituent groups $V_1$ to $V_4$ described previously.

$M_{101}$ is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g., tetraphenylphosphonium), and a guanidine group.

Practical examples of a compound represented by formula (XX), (XXI), or (XXII) are presented below, but the present invention is not limited to these examples.

(XX-1)

$CH_3SO_2SNa$ (XX-2)

$C_2H_5SO_2SNa$ (XX-3)

$C_3H_7SO_2SK$ (XX-4)

$C_4H_9SO_2SLi$ (XX-5)

$C_6H_{13}SO_2SNa$ (XX-6)

$C_8H_{17}SO_2SNa$ (XX-7)

$CH_3(CH_2)_3CH(C_2H_5)CH_2SO_2S{\bullet}NH_4$ (XX-8)

$C_{10}H_{21}SO_2SNa$ (XX-9)

$C_{12}H_{25}SO_2SNa$ (XX-10)

$C_{16}H_{33}SO_2SNa$ (XX-11)

$(CH_3)_2CH—SO_2SK$ (XX-12)

t-$C_4H_9SO_2SNa$ (XX-13)

$CH_3OCH_2CH_2SO_2S{\bullet}Na$ (XX-14)

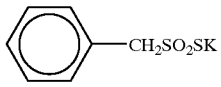

(XX-15)

$CH_2{=}CHCH_2SO_2SNa$

-continued
(XX-16)
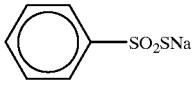
(XX-17)
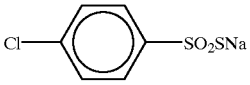
(XX-18)
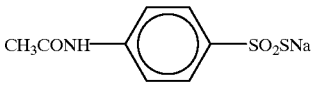
(XX-19)
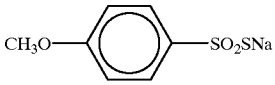
(XX-20)
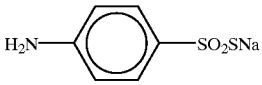
(XX-21)
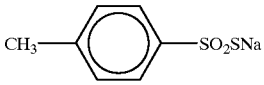
(XX-22)
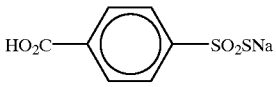
(XX-23)
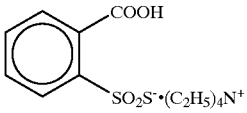
(XX-24)
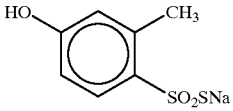
(XX-25)
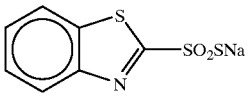
(XX-26)
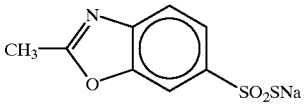
(XX-27)
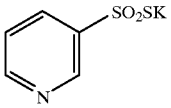
(XX-28)
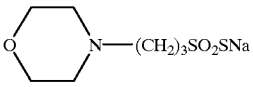
(XX-29)
$KSSO_2(CH_2)_2SO_2SNa$
-continued
(XX-30)
$NaSSO_2(CH_2)_4SO_2SNa$
(XX-31)
$NaSSO_2(CH_2)_4S(CH_2)_4SO_2SNa$
(XX-32)
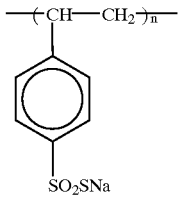
(XX-33)
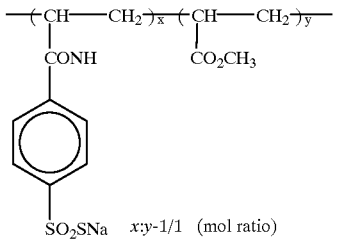
*x*:*y*-1/1 (mol ratio)
(XXI-1)
$C_2H_5SO_2S—CH_3$
(XXI-2)
$C_8H_{17}SO_2SCH_2CH_3$
(XXI-3)
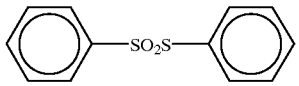
(XXI-4)
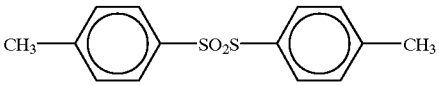
(XXI-5)
$C_2H_5SO_2SCH_2CH_2CH_2CN$
(XXI-6)
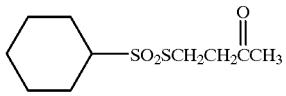
(XXI-7)
$C_4H_9SO_2SCH(CH_3)CH_2CN$
(XXI-8)
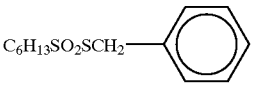
(XXI-9)
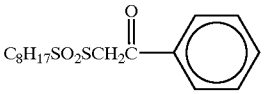

-continued
(XXI-10)
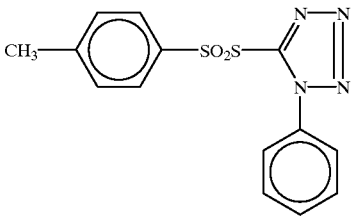
(XXI-11)
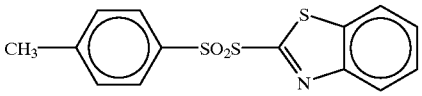
(XXI-12)
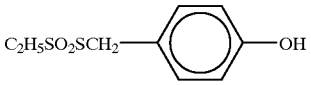
(XXI-13)
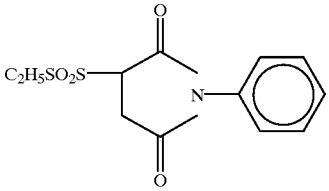
(XXI-14)
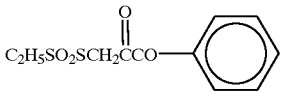
(XXI-15)
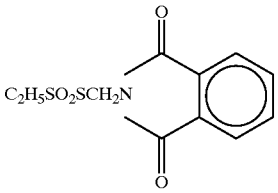
(XXI-16)
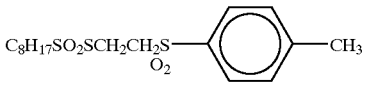
(XXI-17)
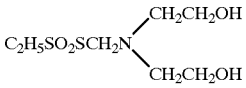
(XXI-18)
$C_2H_5SO_2SCH_2CH_2CH_2CH_2OH$
(XXI-19)
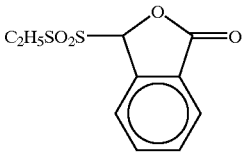
-continued
(XXI-20)
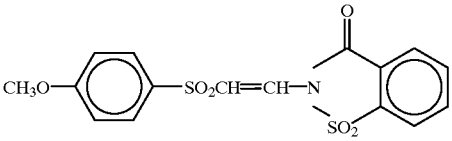
(XXI-21)
$CH_3SSO_2(CH_2)_4SO_2SCH_3$
(XXI-22)
$CH_3SSO_2(CH_2)_2SO_2SCH_3$
(XXI-23)
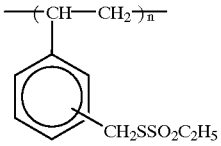
(XXI-24)
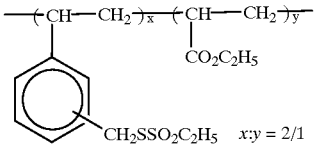
*x*:*y* = 2/1 (mol ratio)
(XXI-25)
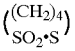
(XXII-1)
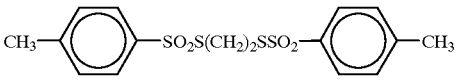
(XXII-2)
$C_2H_5SO_2SCH_2CH_2SO_2CH_2CH_2SSO_2C_2H_5$
(XXII-3)
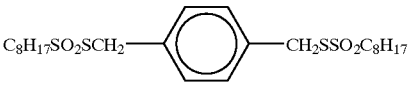
(XXII-4)
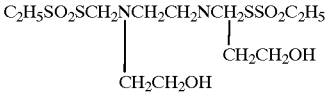
(XXII-5)
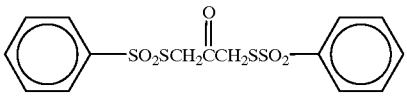
(XXII-6)
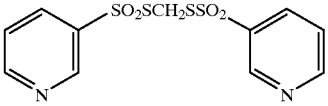
(XXII-7)
$C_2H_5SO_2SSSO_2C_2H_5$
(XXII-8)
$(n)C_3H_7SO_2SSSO_2C_3H_7(n)$
(XXII-9)
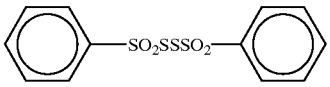

Compounds represented by formula (XX) can be easily synthesized on the basis of methods described in JP-A-54-1019 and British Patent 972,211.

A compound represented by formula (XX), (XXI), or (XXII) is preferably added in an amount of $10^{-7}$ to $10^{-1}$ mol per mol of silver halide. The addition amount is more preferably $10^{-6}$ to $10^{-2}$ mol, and particularly preferably $10^{-5}$ to $10^{-3}$ mol.

To add a compound represented by formula (XX), (XXI), or (XXII) during the preparing process, a method normally used when additives are added to photographic emulsions can be applied. As an example, a water-soluble compound can be added in the form of an aqueous solution with an appropriate concentration. A water-insoluble compound or a compound which is sparingly soluble in water can be added in the form of a solution by dissolving the compound in an appropriate organic solvent which can be mixed in water, e.g., alcohols, glycols, ketones, esters, and amides, and which has no adverse effect on the photographic properties.

A compound represented by formula (XX), (XXI), or (XXII) can be added in any step of the preparation, i.e., during grain formation of a silver halide emulsion or before or after chemical sensitization of the emulsion. A compound is preferably added before or during reduction sensitization. A compound is particularly preferably added during grain growth.

Although a compound can be previously added to a reactor vessel, it is more preferable to add a compound at a proper timing during grain formation. It is also possible to add a compound represented by formula (XX), (XXI), or (XXII) to an aqueous solution of a water-soluble silver salt or a water-soluble alkali halide and form grains by using this aqueous solution. A method by which a solution of a compound represented by formula (XX), (XXI), or (XXII) is separately added several times or continuously added over a long time period with the step of grain formation is also preferable.

Of compounds represented by formulas (XX), (XXI), and (XXII), the most preferable compound with respect to the present invention is a compound represented by formula (XX).

Light-sensitive materials of the present invention are not particularly restricted. Examples are a color negative film, a color positive film, a black-and-white sensitive material, a negative film for movies, and a positive film for movies. That is, at least one light-sensitive layer need only be formed on a support. A typical example is a silver halide photographic light-sensitive material having, on its support, at least one light-sensitive layer constituted by a plurality of silver halide emulsion layers which are sensitive to essentially the same color but have different sensitivities. In the case of a color sensitive material, this light-sensitive layer includes a unit light-sensitive layer which is sensitive to one of blue light, green light, and red light. In a multilayered silver halide color photographic light-sensitive material, these unit light-sensitive layers are generally arranged in the order of red-, green-, and blue-sensitive layers from a support. However, according to the intended use, this arrangement order may be reversed, or light-sensitive layers sensitive to the same color can sandwich another light-sensitive layer sensitive to a different color. Non-light-sensitive layers can be formed between the silver halide light-sensitive layers and as the uppermost layer and the lowermost layer. These interlayers can contain, e.g., couplers, DIR compounds, and color mixing inhibitors (to be described later). As a plurality of silver halide emulsion layers constituting each unit light-sensitive layer, a two-layered structure of high- and low-speed emulsion layers can be preferably used such that the sensitivity is sequentially decreased toward a support as described in West German Patent 1,121,470 or British Patent 923,045. Also, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer. In other words, three layers having different sensitivities may be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer, or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) with an interlayer effect, which is described in U.S. Pat. Nos. 4,663,271, 4,705,744, and 4,707,436 and JP-A-62-160448 and JP-A-63-89580 and different from the main light-sensitive layers BL, GL, and RL in spectral sensitivity distribution, is preferably formed adjacent to or close to the main light-sensitive layers.

A preferable silver halide used in the present invention is silver iodobromide, silver iodochloride, or silver iodochlorobromide containing about 30 mol % or less of silver iodide. A particularly preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected-area diameter of about 10 $\mu$m, and an emulsion may be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferable.

Also, tabular grains having an aspect ratio of about 3 or more can be used in the present invention. Tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

A crystal structure can be uniform, can have different halogen compositions in the interior and the surface layer thereof, or may be a layered structure. Alternatively, a silver halide having a different composition can be bonded by an epitaxial junction, or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior a grain, and an emulsion of another type which has latent images on the surface and in the interior of a grain. However, the emulsion must be a negative type emulsion. In this case, the internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table presented later.

In the light-sensitive material of the present invention, it is possible to simultaneously use, in a single layer, two or more types of emulsions different in at least one of the characteristics of a light-sensitive silver halide emulsion, i.e., the grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the sensitive material. Methods of preparing the internally fogged or surface-fogged silver halide grain are described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver iodobromide, and silver iodochlorobromide can be used. The grain size of these fogged silver halide grains is preferably 0.01 to 0.75 $\mu$m, and particularly preferably 0.05 to 0.6 $\mu$m. The grains can also be regular grains, and the emulsion can be a polydisperse emulsion. However, the emulsion is preferably a monodisperse emulsion (in which at least 95% of the weight or number of grains of silver halide grains have grain sizes within ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent circle diameters of projected areas) of the fine grain silver halide is preferably 0.01 to 0.5 $\mu$m, and more preferably 0.02 to 0.2 $\mu$m.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole compound, an azaindene compound, a benzothiazolium compound, a mercapto compound, or a zinc compound. Colloidal silver can be added to this fine grain silver halide grain-containing layer.

The silver coating amount of the light-sensitive material of the present invention is preferably 10.0 g/m$^2$ or less, more preferably 6.0 g/m$^2$ or less, and most preferably 4.5 g/m$^2$ or less.

Photographic additives usable in the present invention are also described in RDs, and the corresponding portions are summarized in the following Table 1.

TABLE 1

| Types of Additives | RD17643 (Dec., 1978) | RD18716 (Nov., 1979) | RD307105 (Nov., 1989) |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | page 866–868 |
| 4. Brighteners | page 24 | page 648, right column | page 868 |
| 5. Antifoggants and stabilizers | page 24–25 | page 649, right column | page 868–870 |
| 6. Light absorbent, filter dye, | pages 25–26 | page 649, right column | page 873 |

TABLE 1-continued

| Types of Additives | RD17643 (Dec., 1978) | RD18716 (Nov., 1979) | RD307105 (Nov., 1989) |
|---|---|---|---|
| ultra-violet absorbents | | to page 650, left column | |
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left column | page 874–875 |
| 10. Binder | page 26 | page 651, left column | page 873–874 |
| 11. Plasticizers, lubricants | page 27 | page 650, right column | page 876 |
| 12. Coating aids, surface active agents | page 26–27 | page 650, right column | page 875–876 |
| 13. Antistatic agents | page 27 | page 650, right column | page 876–877 |
| 14. Matting agents | | | page 878–879 |

Various dye formation couplers can be used in the light-sensitive material of the present invention, and the following couplers are particularly preferable.

Yellow couplers; couplers represented by formulas (I) and (II) in European Patent 502,424A; couplers represented by formulas (1) and (2) in European Patent 513,496A (particularly Y-28 on page 18); a coupler represented by formula (I) in claim 1 of European Patent 568,037A; a coupler represented by formula (I) in column 1, lines 45 to 55, in U.S. Pat. No. 5,066,576; a coupler represented by formula (I) in paragraph 0008 of JP-A-4-274425; couplers described in claim 1 on page 40 in European Patent 498,381A1 (particularly D-35 on page 18); couplers represented by formula (Y) on page 4 in European Patent 447,969A1 (particularly Y-1 (page 17) and Y-54 (page 41)); and couplers represented by formulas (II) to (IV) in column 7, lines 36 to 58, in U.S. Pat. No. 4,476,219 (particularly II-17, II-19 (column 17), and II-24 (column 19)).

Magenta couplers; JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in European Patent 456,257; M-4 and M-6 (page 26), and M-7 (page 27) in European Patent 486,956; M-45 (page 19) in European Patent 571,959A; (M-1) (page 6) in JP-A-5-204106; and M-22 in paragraph 0237 of JP-A-4-362631.

Cyan couplers; CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385.

Polymer couplers; P-1 and P-5 (page 11) in JP-A-2-44345.

Couplers for forming a colored dye with a proper diffusibility are preferably those described in U.S. Pat. No. 4,366,237, British Patent 2,125,570, European Patent 96,873B, and Germany Patent 3,234,533.

Couplers for correcting unnecessary absorption of a colored dye are preferably yellow colored cyan couplers represented by formulas (CI), (CII), (CIII), and (CIV) described on page 5 in European Patent 456,257A1 (particularly YC-86 on page 84); yellow colored magenta couplers ExM-7 (page 202), EX-1 (page 249), and EX-7 (page 251) in European Patent 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO92/11575 (particularly compound examples on pages 36 to 45).

Examples of a compound (including a coupler) which reacts with a developing agent oxidized form and releases a photographically useful compound residue are as follows. Development inhibitor release compounds: compounds represented by formulas (I), (II), (III), and (IV) on page 11 of European Patent 378,236A1 (particularly T-101 (page 30), T-104 (page 31), T-113 (page 36), T-131 (page 45), T-144 (page 51), and T-158 (page 58)), a compound represented by formula (I) on page 7 of European Patent 436,938A2 (particularly D-49 (page 51)), a compound represented by formula (1) in European Patent 568,037A (particularly (23) (page 11)), and compounds represented by formulas (I), (II), and (III) on pages 5 and 6 of European Patent 440,195A2 (particularly I-(1) on page 29); Bleaching accelerator release compounds: compounds represented by formulas (I) and (I') on page 5 of European Patent 310,125A2 (particularly (60) and (61) on page 61), and compounds represented by formula (I) in claim 1 of JP-A-6-59411 (particularly (7) (page 7)); ligand release compounds: compounds represented by LIG-X described in claim 1 of U.S. Pat. No. 4,555,478 (particularly compounds in column 12, lines 21 to 41); leuco dye release compounds: compounds 1 to 6 in columns 3 to 8 of U.S. Pat. No. 4,749,641; fluorescent dye release compounds: compounds represented by COUP-DYE in claim 1 of U.S. Pat. No. 4,774,181 (particularly compounds 1 to 11 in columns 7 to 10); development accelerators or fogging agent release compounds: compounds represented by formulas (1), (2), and (3) in column 3 of U.S. Pat. No. 4,656,123 (particularly (I-22) in column 25), and ExZK-2 on page 75, lines 36 to 38, in European Patent 450,637A2; compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)); stain inhibitors: formulas (I) to (III) on page 4, lines 30 to 33, particularly I-47, I-72, III-1, and III-27 (pages 24 to 48) in European Patent 298321A; brown inhibitors: A-6, A-7, A-20, A-21, A-23, A-24, A-25, A-26, A-30, A-37, A-40, A-42, A-48 A-63, A-90, A-92, A-94, and A-164 (pages 69 to 118) in European Patent 298321A, II-III-23, particularly III-10, in columns 25 to 38 of U.S. Pat. No. 5,122,444, I-1 to III-4, particularly II-2, on pages 8 to 12 in European Patent 471347A, and A-1 to A-48, particularly A-39 and A-42, in columns 32 to 40 of U.S. Pat. No. 5,139,931; materials which reduce the use amount of a color enhancer or a color amalgamation inhibitor: I-1 to II-15, particularly I-46, on pages 5 to 24 in European Patent 411324A; formalin scavengers: SCV-1 to SCV-28, particularly SCV-8, on pages 24 to 29 in European Patent 477932A; film hardeners: H-1, H-4, H-6, H-8, and H-14 on page 17 in JP-A-1-214845, compounds (H-1 to H-54) represented by formulas (VII) to (XII) in columns 13 to 23 of U.S. Pat. No. 4,618,573, compounds (H-1 to H-76), particularly H-14, represented by formula (6) on page 8, lower right column, in JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7, of U.S. Pat. No. 5,019,492; antiseptic agents and mildewproofing agents: I-1 to III-43, particularly II-1, II-9, II-10, II-18, and III-25, in columns 3 to 15 of U.S. Pat. No. 4,923,790; stabilizers and antifoggants: I-1 to (14), particularly I-1, I-60, (2), and (13), in columns 6 to 16 of U.S. Pat. No. 4,923,793, and compounds 1 to 65, particularly compound 36, in columns 25 to 32 of U.S. Pat. No. 4,952,483; chemical sensitizers: triphenylphosphine, selenide, and compound 50 in JP-A-5-40324; dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450, F-I-1 to F-II-43, particularly F-I-11 and F-II-8, on pages 33 to 55 in European Patent 445627A, III-1 to III-36, particularly III-1 and III-3, on pages 17 to 28 in European Patent 457153A, fine crystal dispersions of Dye-1 to Dye-124 on pages 8 to 26 in WO88/04794, compounds 1 to 22, particularly compound 1, on pages 6 to 11 in European Patent 319999A, compounds D-1 to D-87 (pages 3 to 28) represented by formulas (1) to (3) in European Patent 519306A, compounds 1 to 22 (columns 3 to 10) represented by formula (I) in U.S. Pat. No. 4,268,622, and compounds (1) to (3) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) ad compounds HBT-1 to HBT-10 (page 14) represented by formula (III) in European Patent 520938A, and compounds (1) to (31) (columns 2 to 9) represented by formula (1) in European Patent 521823A.

A support which can be suitably used in the present invention is described in, e.g., RD. No. 17643, page 28, RD. No. 18716, from the right column, page 647 to the left column, page 648, and RD. No. 307105, page 897.

In the light-sensitive material of the present invention, the sum total of film thicknesses of all hydrophilic colloidal layers on the side having emulsion layers is 28 μm or less, preferably 23 μm or less, more preferably 18 μm or less, and most preferably 16 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution primarily consisting of an aromatic primary amine-based color developing agent. Although an aminophenol compound is useful as this color developing agent, a p-phenylenediamine compound is preferably used. Typical examples of the p-phenylenediamine compound are compounds described in European Patent 556700A, page 28, lines 43 to 52. Two or more of these compounds can be used together in accordance with the intended use.

In general, the color developer contains a pH buffering agent such as a carbonate, a borate, or a phosphate of an alkali metal, and a development inhibitor or an antifoggant such as a bromide, an iodide, a benzimidazoles, a benzothiazoles, or a mercapto compound. If necessary, the color developer can also contain various preservatives such as a hydroxylamine, a diethylhydroxylamine, a sulfite, a hydrazine such as N,N-biscarboxymethylhydrazine, a phenylsemicarbazide, a triethanolamine, and a catechol sulfonic acid; an organic solvent such as ethyleneglycol and diethyleneglycol; a development accelerators such as benzylalcohol, polyethyleneglycol, a quaternary ammonium salt, and an amine; a dye forming coupler, a competing coupler, and an auxiliary developing agent such as 1-phenyl-3-pyrazolidone; a viscosity imparting agent; and a various chelating agent such as aminopolycarboxylic acid, aminopolyphosphonic acid, alkylphosphonic acid, and phosphonocarboxylic acid. Representative examples of the chelating agents are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., dihydroxybenzene such as hydroquinone, 3-pyrazolidone such as 1-phenyl-3-pyrazolidone, and aminophenyl such as N-methyl-p-aminophenol can be used singly or together. The pH of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. In order to decrease the quantity of replenisher, an area in which a processing solution contacts air is preferably decreased to prevent evaporation and oxidation of the replenisher upon contact with air.

The contact area of the photographic processing solution with air in a processing tank can be represented by an aperture defined below:

$$\text{Aperture} = [\text{contact area } (cm^2) \text{ of processing with air}] \div v\ [\text{volume } (cm^3) \text{ of processing solution}]$$

The above aperture is preferably 0.1 or less, and more preferably, 0.001 to 0.05. In order to reduce the aperture, a shielding member such as a floating cover can be provided on the liquid surface of the photographic processing solution in the processing tank. In addition, a method of using a movable cover described in JP-A-1-82033 or a slit developing method descried in JP-A-63-216050 can be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching can be performed either simultaneously with fixing (bleach-fixing) or independently of it. In addition, in order to increase a processing speed, bleach-fixing can be performed after bleaching. Also, it is possible to perform processing in a bleach-fixing bath having two continuous tanks, perform fixing before bleach-fixing, or perform bleaching after bleach-fixing, in accordance with the intended use. Examples of the bleaching agent are a compound of a polyvalent metal such as iron(III), peracids (in particular, soda persulfate is suitable to color negative films for movies), quinones, and a nitro compound. Typical examples of the bleaching agent are an organic complex salt of iron(III), e.g., a complex salt of aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Practical examples of useful bleaching accelerators are described in the following specifications: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, JP-A-53-141623, and JP-A-53-18426, and Research Disclosure No. 17129 (July, 1978); a thiazolidine derivative described in JP-A-50-140129; thiourea derivatives described in JP-B-45-8506, JP-A-52-20832 and JP-A-53-32735, U.S. Pat. No. 3,706,561; iodide salts described in West German Patent 1,127,715 and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferable. A compound described in U.S. Pat. No. 4,552,834 is also preferable. These bleaching accelerators can be added in the light-sensitive material. These bleaching accelerators are useful especially in bleach-fixing of a photographic color light-sensitive material.

In addition to the above compounds, the bleaching solution or the bleach-fixing solution preferably contains an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent used in the fixing solution and the bleach-fixing solution are thiosulfate, thiocyanate, a thioether compound, thioureas, and a large amount of iodide. Of these compounds, thiosulfate, especially, ammonium thiosulfate can be used in the widest range of applications. In addition, a combination of thiosulfate and a thiocyanate, a thioether compound, or thiourea is preferably used. As a preservative of the bleach-fixing solution, sulfite, bisulfite, a carbonyl bisulfite adduct, or a sulfinic acid compound described in European Patent 294,769A is preferable. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is 1 to 3 minutes, and more preferably, 1 to 2 minutes. A processing temperature is 25° C. to 50° C., and preferably, 35° C. to 45° C. Within the preferable temperature range, the desilvering speed is increased, and the generation of stains after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, and a method of increasing the stirring effect using rotating means described in JP-A-62-183461. Other examples are a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is considered that the improvement in stirring increases the speed of supply of the bleaching agent and the fixing agent into the emulsion film to lead to an increase in the desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-60-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect is particularly effective to shorten the processing time in each processing step and reduce the quantity of replenisher of the processing solution.

The photographic light-sensitive material of the present invention is normally subjected to washing and/or stabilizing steps after desilvering. An amount of water used in the washing step can be arbitrarity determined over a broad range in accordance with the properties (e.g., a property determined by the substances used, such as a coupler) of the light-sensitive material, the intended use of the material, the temperature of the water, the number of water tanks (the number of stages), a replenishing scheme such as a counter or forward flow, and other various conditions. The relationship between the amount of water and the number of water tanks in a multi-stage counter-flow scheme can be obtained by a method described in "Journal of the Society of Motion Picture and Television Engineering", Vol. 64, PP. 248–253 (May, 1955). According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, it is possible to use a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. One example is a stabilizing bath containing a dye stabilizing agent and a surface-active agent to be used as a final bath of the photographic color light-sensitive material. Examples of the dye stabilizing agent are aldehydes such as formalin and glutaraldehyde, an N-methylol compound, hexamethylene-tetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color photographic light-sensitive material of the present invention can contain a color developing agent in order to simplify the processing and increase the processing speed. For this purpose, various types of precursors of a color developing agent can be preferably used. Examples of the precursor are an indoaniline compound described in U.S. Pat. No. 3,342,597, Schiff base compounds described in U.S. Pat. No. 3,342,599 and Research Disclosure Nos. 14,850 and 15,159, an aldol compound described in Research Disclosure No. 13,924, a metal salt complex described in U.S. Pat. No. 3,719,492, and a urethane compound described in JP-A-53-135628.

The silver halide color photographic light-sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., the processing can be accelerated at a higher temperature to shorten the processing time, or the image quality or stability of a processing solution can be improved at a lower temperature.

The present invention can be preferably applied to a silver halide photographic light-sensitive material having a transparent magnetic recording layer. A silver halide light-sensitive material carrying magnetic recording used in the present invention can be manufactured by annealing a polyester thin-layer support described in detail in JP-A-6-35118 or JP-A-6-17528 or JIII Journal of Technical Disclosure No. 94-6023, e.g., a polyethylene aromatic dicarboxylate polyester support, having a thickness of 50 to 300 $\mu$m, preferably 50 to 200 $\mu$m, more preferably 80 to 115 $\mu$m, and particularly preferably 85 to 105 $\mu$m, at 40° C. to a glass transition temperature for 1 to 1500 hours, performing a surface treatment such as ultraviolet irradiation described in JP-B-43-2603, JP-B-43-2604, or JP-B-45-3828, corona discharge described in JP-B-48-5043 or JP-B-51-131576, or glow discharge described in JP-B-35-7578 or JP-B-46-4348, performing undercoating described in U.S. Pat. No. 5,326,689, forming an underlayer described in U.S. Pat. No. 2,761,791 where necessary, and coating ferromagnetic grains described in JP-A-59-23505, JP-A-4-195726, or JP-A-6-59357.

Note that the magnetic layer described above can also have the shape of stripes described in JP-A-4-124642 or JP-A-4-124645.

In addition, the material is subjected to an antistatic treatment described in JP-A-4-62543 if necessary and finally coated with silver halide emulsions. As the silver halide emulsions, JP-A-4-166932, JP-A-3-41436, and JP-A-3-41437 are used.

It is preferable that the light-sensitive material thus formed be manufactured by a manufacture control method described in JP-B-4-86817 and the manufacturing data be recorded by a method described in JP-B-6-87146. After or before the data recording, the material is cut into a film narrower than a conventional 135 size, and two perforations are formed on each side of each small-format frame such that the frame matches a format frame smaller than a conventional frame.

The film thus manufactured is used after being packed into a cartridge package described in JP-A-4-157459, a cartridge described in FIG. 9 of an example in JP-A-5-210202, a film magazine described in U.S. Pat. No. 4,221,479, or a cartridge described in U.S. Pat. Nos. 4,834,306, 4,834,366, 5,226,613 or 4,846,418.

The film cartridge or the film magazine herein used is preferably a cartridge or a magazine whose tongue can be housed such as described in U.S. Pat. Nos. 4,848,693 or 5,317,355 from the viewpoint of light shielding properties.

Furthermore, it is preferable to use a cartridge having a lock mechanism described in U.S. Pat. No. 5,296,886, a cartridge described in U.S. Pat. No. 5,347,334 which displays the use state, or a cartridge having a double exposure preventing function.

It is also possible to use a cartridge described in JP-A-6-85128 by which a film is easily loaded only by inserting the film into the cartridge.

The film cartridge thus formed can be purposefully used in photography, development, and various pleasures of photography by using cameras, developing machines, and laboratory apparatuses to be described next.

For example, the function of the film cartridge (magazine) can be well achieved by using easy-loading cameras described in JP-A-6-8886 and JP-A-6-99908, an automatic winding camera described in JP-A-6-101135, a camera described in JP-A-6-205690 by which a film can be unloaded and replaced with another during photography, cameras described in JP-A-5-293138 and JP-A-5-283382 by which photographic information such as panorama photography, Highvision photography, and regular photography (capable of magnetic recording by which the print aspect ratio can be selected) can be magnetically recorded on a film, a camera having a double exposure preventing function described in JP-A-6-101194, and a camera having a function of displaying the use state of, e.g., a film described in JP-A-5-150577.

A film thus photographed is processed by an automatic developing machine described in JP-A-6-222514 or JP-A-6-222545. Alternatively, a method of using magnetic recording on a film described in JP-A-6-95265 or JP-A-4-123054 or an aspect ratio selecting function described in JP-A-5-19364 can be used before, during, or after the processing.

If the development is motion picture development, the film is spliced by a method described in JP-A-5-119461.

Attaching and detaching described in JP-A-6-148805 are performed during or after the development.

After the processing, the print information can be converted into prints by back-printing or front-printing the film onto color paper by using a method described in JP-A-2-184835, JP-A-4-18635, or JP-A-6-79968.

Furthermore, the film can be returned to the customer together with an index print and a cartridge described in JP-A-5-11353 or JP-A-5-232594.

EXAMPLES

The present invention will be described in more detail below by way of its examples. However, the present invention is not limited to these examples.

Example 1

(1) Preparation of emulsions

While an aqueous solution prepared by dissolving 6.5 g of potassium bromide and 28 g of inert gelatin with an average molecular weight of 15,000 in 3.5 l of distilled water was well stirred, a 14% aqueous solution of potassium bromide and a 20% aqueous solution of silver nitrate were added to the solution by a double-jet method at fixed flow rates over 1 min at 50° C. and a pBr of 1.0 (in this addition 2.4% of the total silver amount were consumed).

An aqueous gelatin solution (15%, 340 cc) was added, and the resultant solution was stirred at 55° C. Thereafter, a 20% aqueous solution of silver nitrate was added at a fixed flow rate until the pBr reached 1.4 (in this addition 5.0% of the total silver amount were consumed). $1.3\times10^{-5}$ mol of thiourea dioxide was added per mol of silver. In addition, a 20% aqueous solution of potassium bromide ($KBr_{1-x}I_x$: x=0.04) and a 33% aqueous solution of silver nitrate were added by a double-jet method over 43 min (in this addition 50% of the total silver amount were consumed). After $2.8\times10^{-4}$ mol of sodium ethylthiosulfonate was added per mol of silver, an aqueous solution containing 8.3 g of potassium iodide was added, 14.5 ml of an aqueous solution of 0.001 wt % $K_3IrCh_6$ were added, and a 20% potassium bromide solution and a 33% aqueous solution of silver nitrate were added by a double-jet iethod over 39 min (in this addition 42.6% of the total silver amount were consumed). The amount of silver nitrate used in this emulsion was 425 g. The emulsion was then desalted by a conventional flocculation method, and the pAg and the pH were adjusted to 8.2 and 5.8, respectively, at 40° C. The prepared emulsion was a tabular silver iodobromide emulsion (Em-1) having an average aspect ratio of 6.7, a variation coefficient of 18%, and an equivalent-sphere diameter of 0.85 $\mu$m. It was found by observation performed at a liquid $N_2$ temperature by using a 200-kV transmission electron microscope that, on the average, 50 or more dislocation lines were present per grain in a portion near the periphery of a tabular grain.

Sensitizing dyes SD-1 to SD-7 listed in Table 3 below were added in amounts shown in Table 3 below to the emulsion Em-1 thus prepared, and gold-selenium-sulfur sensitization was optimally performed by using sodium thiosulfate, chloroauric acid, N,N-dimethylselenourea, and potassium thiocyanate, thereby forming emulsions No. 151 to No. 171. Additionally, emulsions No. 101 to No. 121 were formed by adding sensitizing dyes shown in Table 2 below to a tabular silver iodobromide emulsion (Em-2) formed by omitting the step of adding thiourea dioxide and sodium ethylthiosulfonate from the emulsion formulation described above.

TABLE 2

| Prepared Emulsions | | |
|---|---|---|
| Emulsion No. | Presence/absence of reduction sensitization | Types and addition amounts of sensitizing dyes (mol/molAg) |
| 101 | Absence | SD-1 ($4.9 \times 10^{-4}$ mol/molAg) |
| 102 | Absence | (1) ($4.9 \times 10^{-4}$ mol/molAg) |
| 103 | Absence | (5) ($4.9 \times 10^{-4}$ mol/molAg) |
| 104 | Absence | SD-2 ($4.9 \times 10^{-4}$ mol/molAg) |
| 105 | Absence | (11) ($4.9 \times 10^{-4}$ mol/molAg) |
| 106 | Absence | (14) ($4.9 \times 10^{-4}$ mol/molAg) |
| 107 | Absence | SD-3 ($4.9 \times 10^{-4}$ mol/molAg) |
| 108 | Absence | (15) ($4.9 \times 10^{-4}$ mol/molAg) |
| 109 | Absence | SD-4 ($4.9 \times 10^{-4}$ mol/molAg) |
| 110 | Absence | (17) ($4.9 \times 10^{-4}$ mol/molAg) |
| 111 | Absence | (18) ($4.9 \times 10^{-4}$ mol/molAg) |
| 112 | Absence | SD-2 ($3.5 \times 10^{-4}$ mol/molAg) + SD-3 ($9.2 \times 10^{-5}$ mol/molAg) + SD-4 ($4.6 \times 10^{-5}$ mol/molAg) |
| 113 | Absence | (11) ($3.5 \times 10^{-4}$ mol/molAg) + (15) ($9.2 \times 10^{-5}$ mol/molAg) + (17) ($4.6 \times 10^{-5}$ mol/molAg) |
| 114 | Absence | SD-5 ($4.9 \times 10^{-4}$ mol/molAg) |
| 115 | Absence | (20) ($4.9 \times 10^{-4}$ mol/molAg) |
| 116 | Absence | (23) ($4.9 \times 10^{-4}$ mol/molAg) |
| 117 | Absence | SD-6 ($4.7 \times 10^{-4}$ mol/molAg) + SD-7 ($2.0 \times 10^{-5}$ mol/molAg) |
| 118 | Absence | (25) ($4.7 \times 10^{-4}$ mol/molAg) + (30) ($2.0 \times 10^{-5}$ mol/molAg) |
| 119 | Absence | (27) ($4.7 \times 10^{-4}$ mol/molAg) + (30) ($2.0 \times 10^{-5}$ mol/molAg) |
| 120 | Absence | SD-5 ($2.0 \times 10^{-4}$ mol/molAg) + SD-6 ($2.7 \times 10^{-4}$ mol/molAg) + SD-7 ($2.0 \times 10^{-5}$ mol/molAg) |
| 121 | Absence | (20) ($2.0 \times 10^{-4}$ mol/molAg) + (27) ($2.7 \times 10^{-4}$ mol/molAg) + (30) ($2.0 \times 10^{-5}$ mol/molAg) |

TABLE 3

| Prepared Emulsions | | |
|---|---|---|
| Emulsion No. | Presence/absence of reduction sensitization | Types and addition amounts of sensitizing dyes (mol/molAg) |
| 151 | Presence | SD-1 ($4.9 \times 10^{-4}$ mol/molAg) |
| 152 | Presence | (1) ($4.9 \times 10^{-4}$ mol/molAg) |
| 153 | Presence | (5) ($4.9 \times 10^{-4}$ mol/molAg) |
| 154 | Presence | SD-2 ($4.9 \times 10^{-4}$ mol/molAg) |
| 155 | Presence | (11) ($4.9 \times 10^{-4}$ mol/molAg) |
| 156 | Presence | (14) ($4.9 \times 10^{-4}$ mol/molAg) |
| 157 | Presence | SD-3 ($4.9 \times 10^{-4}$ mol/molAg) |
| 158 | Presence | (15) ($4.9 \times 10^{-4}$ mol/molAg) |
| 159 | Presence | SD-4 ($4.9 \times 10^{-4}$ mol/molAg) |
| 160 | Presence | (17) ($4.9 \times 10^{-4}$ mol/molAg) |
| 161 | Presence | (18) ($4.9 \times 10^{-4}$ mol/molAg) |
| 162 | Presence | SD-2 ($3.5 \times 10^{-4}$ mol/molAg) + SD-3 ($9.2 \times 10^{-5}$ mol/molAg) + SD-4 ($4.6 \times 10^{-5}$ mol/molAg) |
| 163 | Presence | (11) ($3.5 \times 10^{-4}$ mol/molAg) + (15) ($9.2 \times 10^{-5}$ mol/molAg) + (17) ($4.6 \times 10^{-5}$ mol/molAg) |
| 164 | Presence | SD-5 ($4.9 \times 10^{-4}$ mol/molAg) |
| 165 | Presence | (20) ($4.9 \times 10^{-4}$ mol/molAg) |
| 166 | Presence | (23) ($4.9 \times 10^{-4}$ mol/molAg) |
| 167 | Presence | SD-6 ($4.7 \times 10^{-4}$ mol/molAg) + SD-7 ($2.0 \times 10^{-5}$ mol/molAg) |
| 168 | Presence | (25) ($4.7 \times 10^{-4}$ mol/molAg) + (30) ($2.0 \times 10^{-5}$ mol/molAg) |
| 169 | Presence | (27) ($4.7 \times 10^{-4}$ mol/molAg) + (30) ($2.0 \times 10^{-5}$ mol/molAg) |
| 170 | Presence | SD-5 ($2.0 \times 10^{-4}$ mol/molAg) + SD-6 ($2.7 \times 10^{-4}$ mol/molAg) + SD-7 ($2.0 \times 10^{-5}$ mol/molAg) |
| 171 | Presence | (20) ($2.0 \times 10^{-4}$ mol/molAg) + (27) ($2.7 \times 10^{-4}$ mol/molAg) + (30) ($2.0 \times 10^{-5}$ mol/molAg) |

(2) Forming of samples

Samples No. 1001 to No. 1021 and No. 1051 to No. 1071, listed in Tables 5 and 6 to be presented later, were formed by coating a triacetylcellulose support having an undercoat layer with emulsion layers and protective layers in coating conditions shown in Table 4 below.

TABLE 4
Emulsion coating Conditions
(1) Emulsion layer
Emulsion emulsions 101 to 125, 151/175
(silver $2.1 \times 10^{-2}$ mol/$m^2$)
Coupler ($1.5 \times 10^{-3}$ mol/$m^2$)
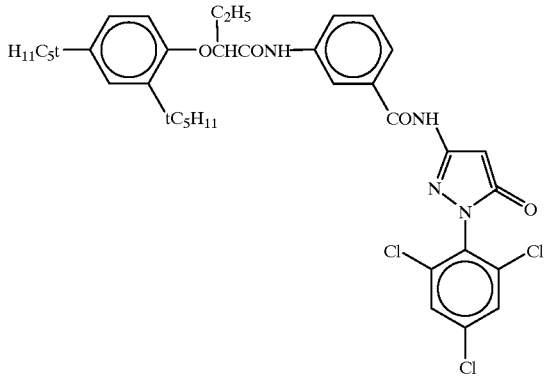
Tricresylphosphate (1.10 g/$m^2$)
Gelatin (1.80 g/$m^2$)
(2) Protective layer
2,4-dichlorotriazine-6-hydroxy-s-triazine
sodium salt (0.08 g/$m^2$)
Gelatin (1.80 g/$m^2$)
SD-1
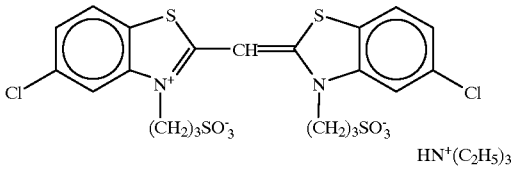
SD-2
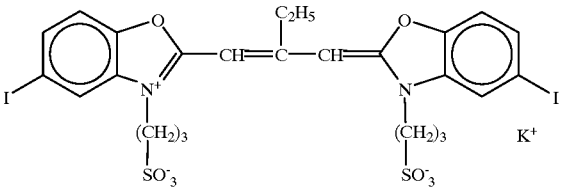
SD-3
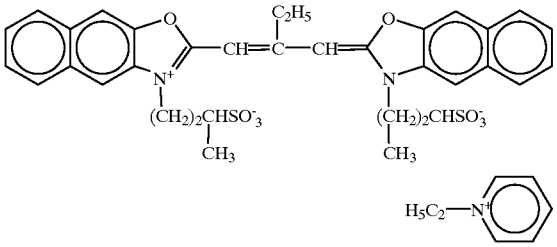
SD-4
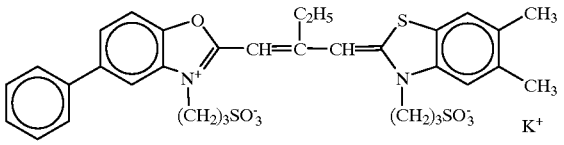

TABLE 4-continued

SD-5

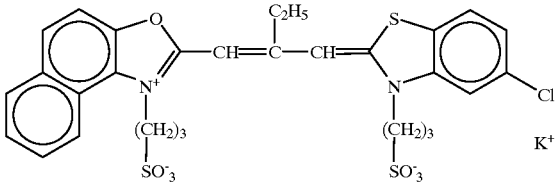

SD-6

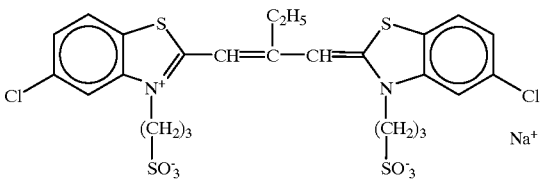

SD-7

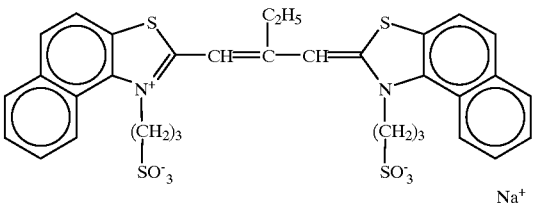

The samples No. 1001 to No. 1003 and the samples No. 1051 to No. 1053 were given sensitometry exposure for 1/100 sec at a color temperature of 4800° K. through a continuous wedge and a gelatin filter SC-39 manufactured by Fuji Photo Film Co., Ltd. The samples No. 1004 to No. 1021 and the samples No. 1054 to No. 1071 were given sensitometry exposure for 1/100 sec at a color temperature of 4800° K. through a continuous wedge and a gelatin filter SC-50 manufactured by Fuji Photo Film Co., Ltd. The resultant samples were subjected to the following color development. The development herein used was done under the following conditions at 38° C.

Processing Method

| Step | Time | Temperature | Quantity of replenisher* | Tank volume |
|---|---|---|---|---|
| Color development | 2 min. 45 sec. | 38° C. | 33 ml | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| Washing (1) | 1 min. 05 sec. | 24° C. | Counter flow system from (2) to (1) | 10 l |
| Washing (2) | 1 min. 00 sec. | 24° C. | 1200 ml | 10 l |
| Washing (3) | 1 min. 05 sec. | 38° C. | 25 ml | 10 l |
| Drying | 4 min. 20 sec. | 55° C. | | |

*A quantity of replenisher is represented by a value per 1 m of a 35-mm wide sample.

The compositions of the processing solutions will be described below.

| | Mother solution (g) | Replenishment solution (g) |
|---|---|---|
| (Color developer solution) | | |
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethy1-N-β-hydroxylethylamino)-2-methylaniline sulfate | 4.5 | 5.5 |
| Water to make | 1.0 l | 1.0 l |
| pH | 10.05 | 10.10 |
| (Bleaching solution) | | |
| Ferric Sodium ethylenediamine-tetraacetate trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing solution) | | |
| Disodium ethylene-diaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |

-continued

| | Mother solution (g) | Replenishment solution (g) |
|---|---|---|
| (Stabilizing solution) | | |
| Formalin (37%) | 2.0 ml | 3.0 ml |
| Polyoxyethylene-p-monononylphenylether (average polymerization degree = 10) | 0.3 | 0.45 |
| Disodium ethylenediaminetetraacetate | 0.05 | 0.08 |
| Water to make | 1.0 l | 1.0 l |
| pH | 5.8–8.0 | 5.8–8.0 |

The densities of the processed samples were determined.

As the sensitivity, the relative value of the reciprocal of an exposure amount required to make the optical density higher by 0.2 than fog was indicated as a fresh sensitivity. Also, unexposed films were aged at a relative humidity of 60% and 60° C. for 4 days and similarly exposed and developed, and the sensitivity and fog were evaluated in the same manner as above.

The results thus obtained are summarized in Tables 5 and 6 below. Note that the sample No. 101 is used as the reference (100) of sensitivity.

TABLE 5

| | Emulsion used | Fresh | | After aging | |
|---|---|---|---|---|---|
| Sample No. | (not reduction-sensitized) | Relative sensitivity | Fog | Relative sensitivity | Fog |
| 1001 (Comparative Examples) | 101 | 100 (Reference) | 0.22 | 60 | 0.33 |
| 1002 (Comparative Examples) | 102 | 98 | 0.22 | 60 | 0.33 |
| 1003 (Comparative Examples) | 103 | 100 | 0.21 | 58 | 0.33 |
| 1004 (Comparative Examples) | 104 | 127 | 0.23 | 80 | 0.48 |
| 1005 (Comparative Examples) | 105 | 124 | 0.23 | 75 | 0.50 |
| 1006 (Comparative Examples) | 106 | 117 | 0.23 | 77 | 0.47 |
| 1001 (Comparative Examples) | 107 | 136 | 0.23 | 103 | 0.46 |
| 1008 (Comparative Examples) | 108 | 136 | 0.21 | 101 | 0.45 |
| 1009 (Comparative Examples) | 109 | 145 | 0.22 | 115 | 0.40 |
| 1010 (Comparative Examples) | 110 | 135 | 0.20 | 112 | 0.39 |
| 1011 (Comparative Examples) | 111 | 142 | 0.22 | 115 | 0.40 |
| 1012 (Comparative Examples) | 112 | 163 | 0.23 | 114 | 0.44 |
| 1013 (Comparative Examples) | 113 | 152 | 0.23 | 115 | 0.43 |
| 1014 (Comparative Examples) | 114 | 159 | 0.22 | 103 | 0.38 |
| 1015 (Comparative Examples) | 115 | 157 | 0.21 | 99 | 0.37 |
| 1016 (Comparative Examples) | 116 | 152 | 0.22 | 99 | 0.36 |
| 1017 (Comparative Examples) | 117 | 177 | 0.21 | 123 | 0.36 |
| 1018 (Comparative Examples) | 118 | 177 | 0.21 | 124 | 0.36 |
| 1019 (Comparative Examples) | 119 | 172 | 0.21 | 123 | 0.35 |
| 1020 (Comparative Examples) | 120 | 186 | 0.23 | 145 | 0.37 |
| 1021 (Comparative Examples) | 121 | 180 | 0.21 | 145 | 0.37 |

TABLE 6

| Sample No. | Emulsion used (reduction-sensitized) | Fresh Relative sensitivity | Fresh Fog | After aging Relative sensitivity | After aging Fog |
|---|---|---|---|---|---|
| 1051 (Comparative Examples) | 151 | 170 | 0.31 | 123 | 0.52 |
| 1052 (Present Invention) | 152 | 182 | 0.24 | 155 | 0.41 |
| 1053 (Present Invention) | 153 | 200 | 0.22 | 140 | 0.35 |
| 1054 (Comparative Examples) | 154 | 192 | 0.56 | 113 | 1.22 |
| 1055 (Present Invention) | 155 | 226 | 0.33 | 206 | 0.54 |
| 1056 (Present Invention) | 156 | 199 | 0.36 | 162 | 0.62 |
| 1057 (Comparative Examples) | 157 | 206 | 0.54 | 130 | 0.98 |
| 1058 (Present Invention) | 158 | 225 | 0.30 | 192 | 0.50 |
| 1059 (Comparative Examples) | 159 | 214 | 0.51 | 162 | 0.79 |
| 1060 (Present Invention) | 160 | 226 | 0.28 | 206 | 0.40 |
| 1061 (Present Invention) | 161 | 223 | 0.30 | 194 | 0.45 |
| 1062 (Comparative Examples) | 162 | 220 | 0.44 | 152 | 0.80 |
| 1063 (Present Invention) | 163 | 235 | 0.30 | 209 | 0.44 |
| 1064 (Comparative Examples) | 164 | 225 | 0.44 | 142 | 0.77 |
| 1065 (Present Invention) | 165 | 255 | 0.33 | 227 | 0.39 |
| 1066 (Present Invention) | 166 | 235 | 0.35 | 191 | 0.54 |
| 1067 (Comparative Examples) | 167 | 233 | 0.40 | 161 | 0.71 |
| 1068 (Present Invention) | 168 | 256 | 0.32 | 218 | 0.52 |
| 1069 (Present Invention) | 169 | 260 | 0.29 | 237 | 0.40 |
| 1070 (Comparative Examples) | 170 | 251 | 0.33 | 174 | 0.71 |
| 1071 (Present Invention) | 171 | 272 | 0.26 | 248 | 0.38 |

As is apparent from the results shown in Tables 5 and 6, a dye represented by formula (I) of the present invention has a significantly high sensitivity, a low fog, and a high storage stability in the reduction-sensitized emulsions.

More specifically, in the non-reduction-sensitized emulsions in Table 5, a dye represented by formula (I) of the present invention has a storage stability equivalent to those of dyes of comparative examples but has a lower sensitivity than those of the comparative examples. In contrast, it is surprising that in the reduction-sensitized emulsions in Table 6, a dye represented by formula (I) of the present invention has a uniquely high sensitivity and a low fog. In particular, an increase in fog after aging was significantly improved. As can be seen by comparing the samples No. 1051 to No. 1053 with the samples No. 1054 to No. 1071, this effect of improving an increase in fog after aging is larger in a trimethine dye than in a monomethine dye.

Example 2

Undercoated cellulose triacetate film supports were coated with a plurality of layers having the compositions presented below, thereby forming multilayered color sensitive materials No. 2001 to No. 2004.

(Compositions of light-sensitive layers)

The main materials used in the individual layers were classified as follows.

| | | | |
|---|---|---|---|
| ExC: | Cyan coupler | UV: | Ultraviolet absorbent |
| ExM: | Magenta coupler | HBS: | High-boiling organic solvent |
| ExY: | Yellow coupler | H: | Gelatin hardener |
| ExS: | Sensitizing dye | | |

The number corresponding to each component indicates the coating amount in units of g/m$^2$. The coating amount of a silver halide is represented by the amount of silver. The coating amount of each sensitizing dye is represented in units of mols per mol of silver halide in the same layer.

| | |
|---|---|
| 1st layer (Antihaiation layer) | |
| Black colloidal silver | silver 0.09 |
| Gelatin | 1.60 |
| ExM-1 | 0.12 |
| ExF-1 | $2.0 \times 10^{-3}$ |
| Solid dispersion dye ExF-2 | 0.030 |
| Solid dispersion dye ExF-3 | 0.040 |
| HBS-1 | 0.15 |
| HBS-2 | 0.02 |
| 2nd layer (Interlayer) | |
| Silver iodobroinide emulsion M | silver 0.065 |
| ExC-2 | 0.04 |
| Polyethylacrylate latex | 0.20 |
| Gelatin | 1.04 |
| 3rd layer (Low-speed red-sensitive exmulsion layer) | |
| Silver iodobromide emulsion A | silver 0.25 |
| Silver iodobromide emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| 4th layer (Medium-speed red-sensitive emulsion layer) | |
| Silver iodobromide emulsion C | silver 0.68 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |

-continued

| | |
|---|---|
| Cpd-2 | 0.023 |
| HBS-1 | 0.10 |
| Gelatin | 0.75 |
| 5th layer (High-speed red-sensitive emulsion layer) | |
| Silver iodobromide emulsion D | silver 1.44 |

As shown in Table 8, dyes ((SD-5)($1.9\times10^{-4}$)+(SD-6)($3\times10^{-4}$)+(SD-7)($1.5\times10^{-5}$)) of the emulsion 120, or dyes ((20)($1.9\times10^{-4}$)+(27)($3\times10^{-4}$)+(30)($1.5\times10^{-5}$)) of the emulsion 121 were used.

| | |
|---|---|
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| 6th layer (Interlayer) | |
| Cpd-1 | 0.090 |
| Solid dispersion dye ExF-4 | 0.030 |
| HBS-1 | 0.050 |
| Polyethylacrylate latex | 0.15 |
| Gelatin | 1.10 |
| 7th layer (Low-speed green-sensitive emulsion layer) | |
| Silver iodobromide emulsion E | silver 0.15 |
| Silver iodobromide emulsion F | silver 0.10 |
| Silver iodobromide emulsion G | silver 0.10 |
| ExS-4 | $3.0\times10^{-4}$ |
| ExS-5 | $2.1\times10^{-4}$ |
| ExS-6 | $8.0\times10^{-4}$ |
| ExM-2 | 0.33 |
| ExM-3 | 0.086 |
| ExY-1 | 0.015 |
| HBS-1 | 0.30 |
| HBS-3 | 0.oio |
| Gelatin | 0.73 |
| 8th layer (Medium-speed green-sensitive emulsion layer) | |
| Silver iodobromide emulsion H | silver 0.83 |
| ExS-4 | $3.2\times10^{-4}$ |
| ExS-5 | $2.2\times10^{-4}$ |
| ExS-6 | $8.4\times10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0\times10^{-3}$ |
| Gelatin | 0.80 |
| 9th layer (High-speed green-sensitive emulsion layer) | |
| Silver iodobromide emulsion I | silver 1.22 |

As shown in Table 8, dyes ((SD-2)($3.4\times10^{-4}$)+(SD-3)($8.8\times10^{-5}$)+(SD-4)($4.6\times10^{-5}$)) of the emulsion 112, or dyes ((11)($3.4\times10^{-4}$)+(15)($8.8\times10^{-4}$)+(17)($4.6\times10^{-5}$)) of the emulsion 113 were used.

| | |
|---|---|
| ExC-1 | 0.010 |
| ExM-1 | 0.020 |
| ExM-4 | 0.025 |
| ExM-5 | 0.040 |

-continued

| | |
|---|---|
| Cpd-3 | 0.040 |
| HBS-1 | 0.25 |
| Polyethylacrylate latex | 0.15 |
| Gelatin | 1.33 |
| 10th layer (Yellow filter layer) | |
| Yellow colloidal silver | silver 0.015 |
| Cpd-1 | 0.16 |
| Solid dispersion dye ExF-5 | 0.060 |
| Solid dispersion dye ExF-6 | 0.060 |
| Oil-soluble dye ExF-7 | 0.010 |
| HBS-1 | 0.60 |
| Gelatin | 0.60 |
| 11th layer (Low-speed blue-sensitive emulsion layer) | |
| Silver iodobromide emulsion J | silver 0.08 |
| Silver iodobromide emulsion K | silver 0.08 |
| ExS-7 | $8.6\times10^{-4}$ |
| ExC-8 | $7.0\times10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0\times10^{-3}$ |
| HBS-1 | 0.28 |
| Gelatin | 1.20 |
| 12th layer (High-speed blue-sensitive emulsion layer) | |
| Silver iodobromide emulsion L | silver 1.05 |

As shown in Table 8, a dye ((SD-1)($4.3\times10^{-4}$)) of the emulsion 101 or a dye ((5)($4.3\times10^{-4}$)) of the emulsion 103 was used.

| | |
|---|---|
| ExY-2 | 0.10 |
| ExY-3 | 0.10 |
| ExY-4 | 0.010 |
| Cpd-2 | 0.10 |
| Cpd-3 | $1.0\times10^{-3}$ |
| HBS-1 | 0.070 |
| Gelatin | 0.70 |
| 13th layer (1st protective layer) | |
| UV-1 | 0.19 |
| UV-2 | 0.075 |
| UV-3 | 0.065 |
| HBS-1 | $5.0\times10^{-2}$ |
| HBS-4 | $5.0\times10^{-2}$ |
| Gelatin | 1.8 |
| 14th (2nd protective layer) | |
| Silver iodobromide emulsion M | silver 0.10 |
| H-1 | 0.40 |
| B-1 (diameter 1.7 $\mu$m) | $5.0\times10^{-2}$ |
| B-2 (diameter 1.7 $\mu$m) | 0.15 |
| B-3 | 0.05 |
| S-1 | 0.20 |
| Gelatin | 0.70 |

In addition to the above components, to improve the storage stability, processability, a resistance to pressure, antiseptic and mildewproofing properties, antistatic properties, and coating properties, the individual layers were made contain W-1 to W-3, B-4 to B-6, F-1 to F-17, iron salt, lead salt, gold salt, oscillation salt, iridium salt, and rhodium salt.

Table 7 below shows the average AgI contents and the grain sizes of the emulsions A to M used in the formation of these samples.

TABLE 7

| | Average AgI content (%) | Variation coefficient according to intergrain AgI content (%) | Average grain size represented by equivalent sphere diameter (μm) | Variation coefficient according to grain size (%) | Project area size represented by equivalent circle diameter (μm) | Diameter/thickness ratio |
|---|---|---|---|---|---|---|
| Emulsion A | 1.7 | 10 | 0.46 | 15 | 0.56 | 5.5 |
| B | 3.3 | 7 | 0.57 | 20 | 0.78 | 4.0 |
| C | 8.9 | 18 | 0.66 | 17 | 0.87 | 5.8 |
| D | 8.7 | 18 | 0.84 | 26 | 1.03 | 3.7 |
| E | 1.7 | 10 | 0.46 | 15 | 0.56 | 5.5 |
| F | 3.3 | 15 | 0.57 | 13 | 0.78 | 4.0 |
| G | 8.8 | 13 | 0.61 | 17 | 0.77 | 4.4 |
| H | 8.8 | 25 | 0.61 | 23 | 0.77 | 4.4 |
| I | 8.7 | 18 | 0.84 | 18 | 1.03 | 3.7 |
| J | 1.7 | 10 | 0.46 | 15 | 0.50 | 4.2 |
| K | 8.8 | 15 | 0.64 | 19 | 0.85 | 5.2 |
| L | 14.2 | 18 | 1.28 | 19 | 1.46 | 3.5 |
| M | 1.0 | — | 0.07 | 15 | — | 1 |

In Table 7, (1) The emulsions D and I to L were subjected to reduction sensitization during grain preparation by using thiourea dioxide and thiosulfonic acid (XX-16) in accordance with the examples in JP-A-2-191938.

Also, an emulsion adjusted following the same procedure as above except that p-quinone was used instead of (XX-16) was formed.

(2) The emulsions A to L were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The preparation of tabular grains was performed by using low-molecular weight gelatin in accordance with the examples JP-A-1-158426.

(4) Dislocation lines as described in JP-A-3-237450 were observed in tabular grains when a high-voltage electron microscope was used.

(5) The emulsion L consisted of double structure grains containing an internally high iodide core described in JP-A-60-143331.

Preparation of dispersions of organic solid dispersion dyes

ExF-2 was dispersed by the following method. That is, 21.7 ml of water, 3 ml of a 5% aqueous solution of sodium p-octylphenoxyethoxyethanesulfonate, and 0.5 g of a 5% aqueous solution of p-octylphenoxypolyoxyethyleneether (polymerization degree 10) were placed in a 700-ml pocket mill, and 5.0 g of the dye ExF-2 and 500 ml of zirconium oxide beads (diameter 1 mm) were added to the mill. The contents were dispersed for 2 hours. This dispersion was done by using a BO type oscillating ball mill manufactured by Chuo Koki K.K. The dispersion was removed from the mill and added with 8 g of a 12.5% aqueous solution of gelatin. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of European Patent 549,489A. The average grain size was found to be 0.06 μm.

The compounds used in the formation of the above layers are presented below.

ExC-1

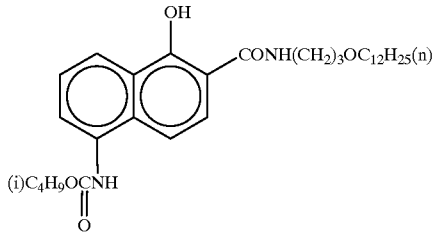

-continued
ExC-2
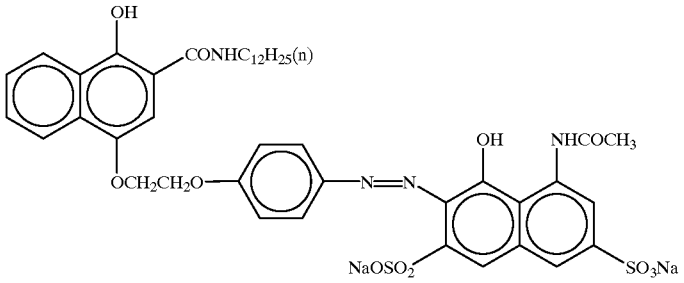
ExC-3
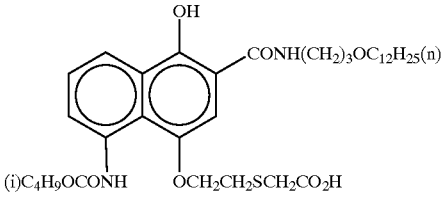
ExC-4
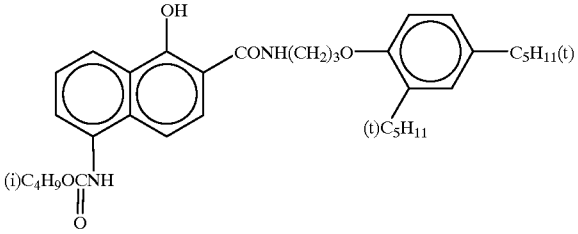
ExC-5
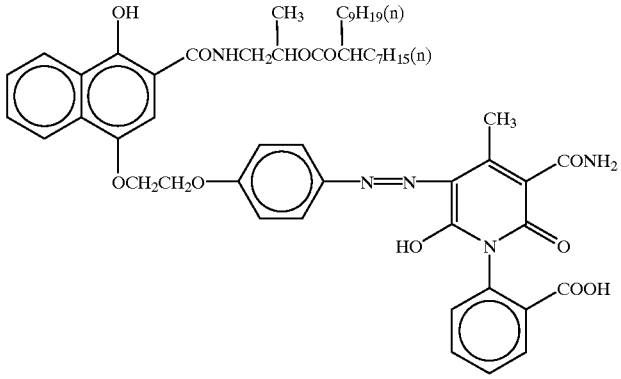
ExC-6
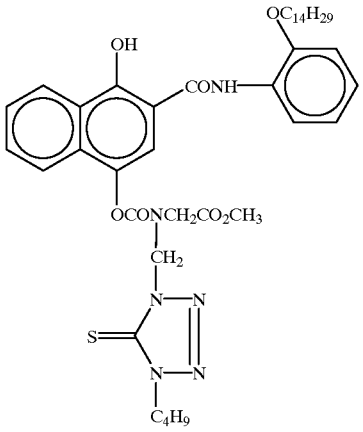

-continued
ExC-7
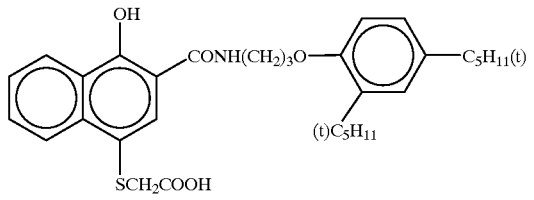
ExC-8
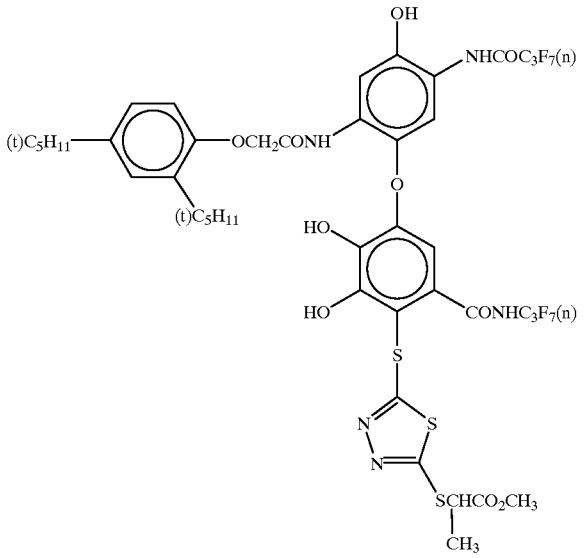
ExM-1
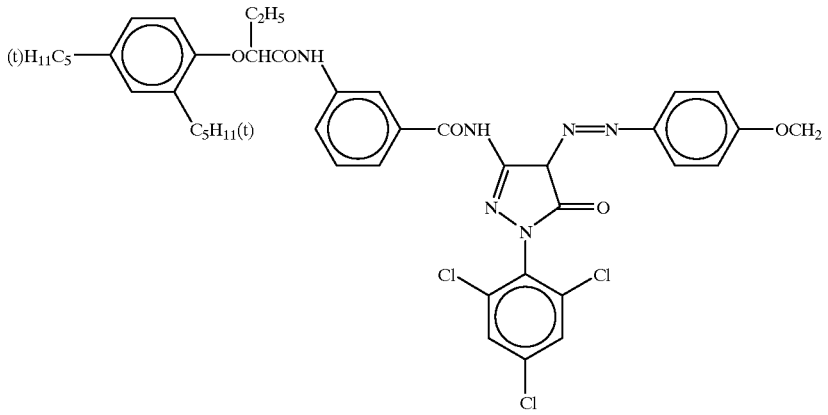
ExM-2
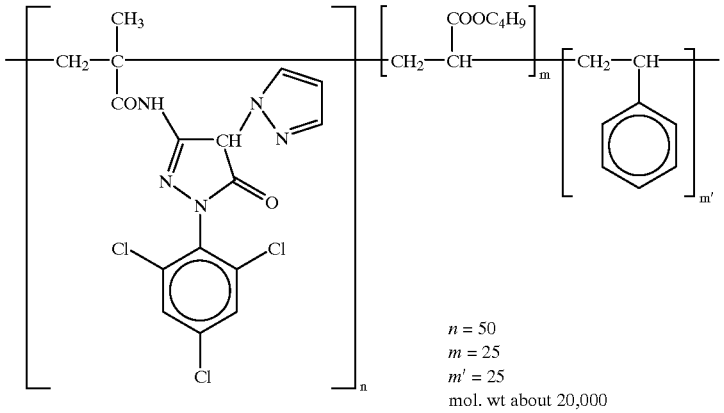
$n$ = 50
$m$ = 25
$m'$ = 25
mol. wt about 20,000

-continued
ExM-3
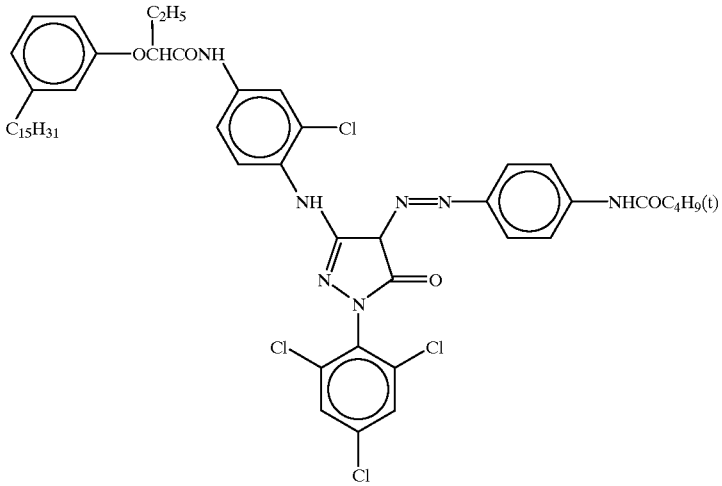
ExM-4
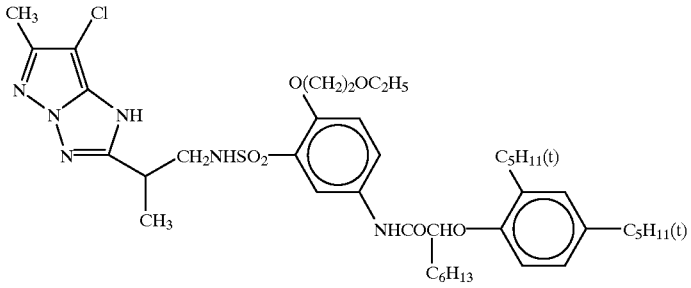
ExM-5
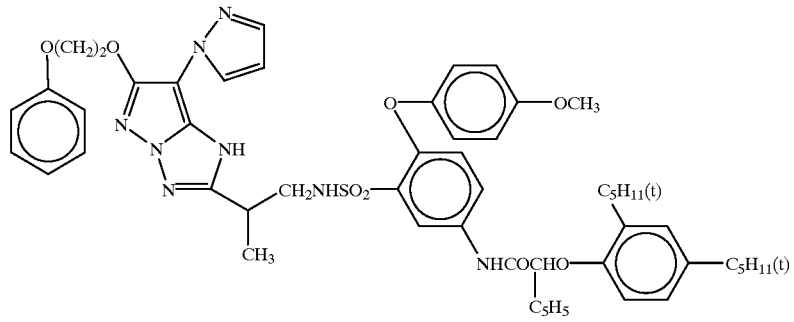
ExY-1
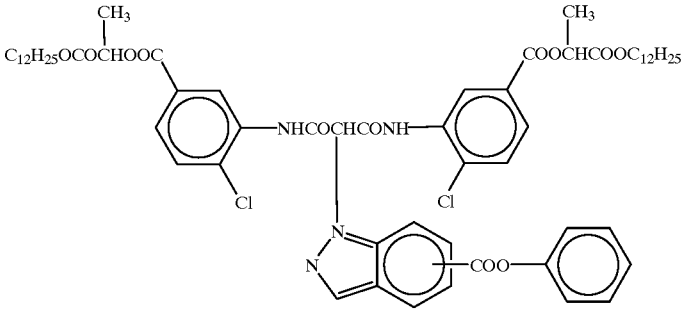

-continued
ExY-2
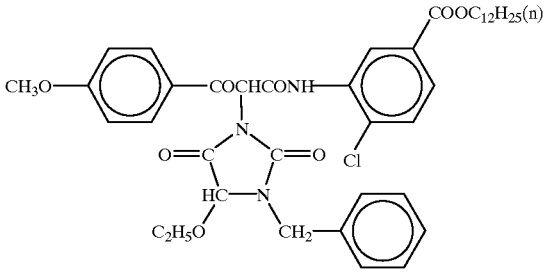
ExY-3
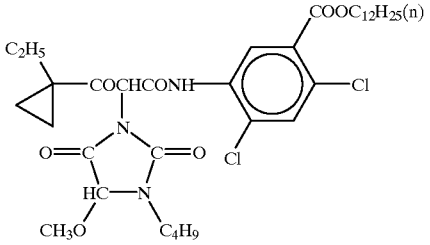
ExY-4
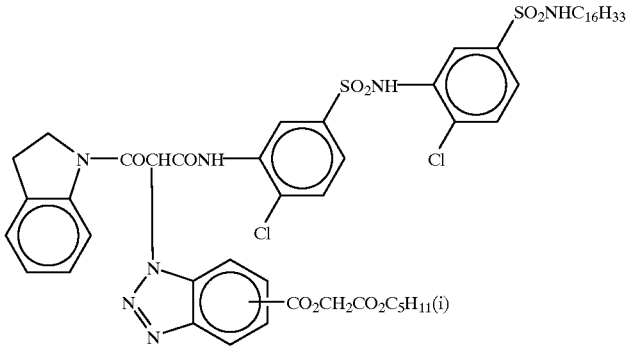
ExY-5
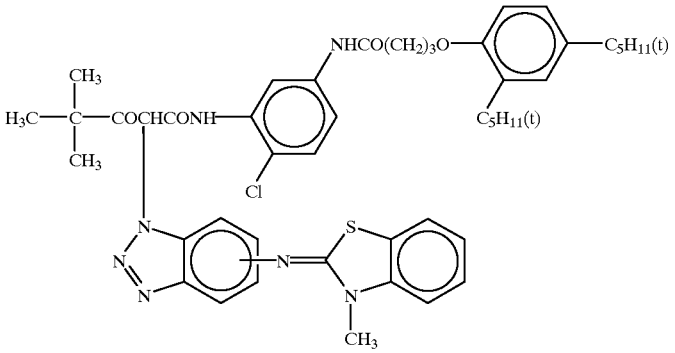
ExF-1
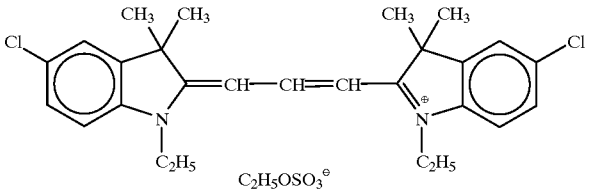

-continued
ExF-2
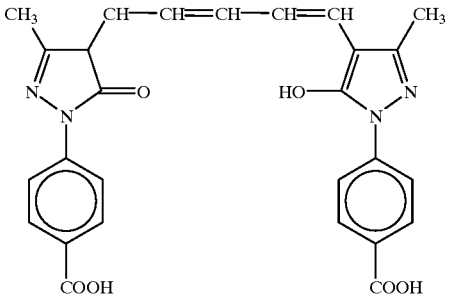
ExF-3
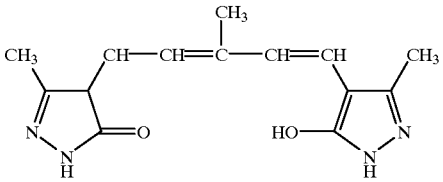
ExF-4
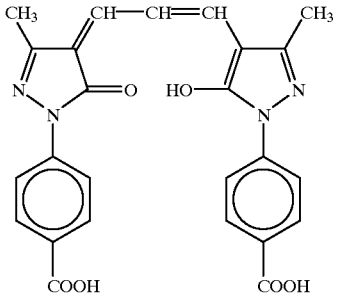
ExF-5
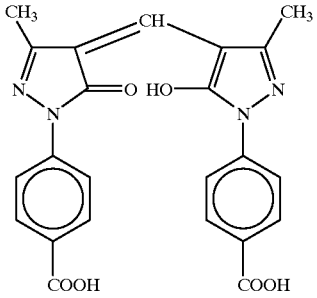
ExF-6
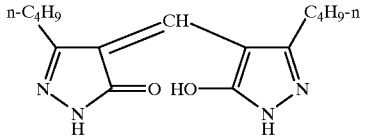
ExF-7
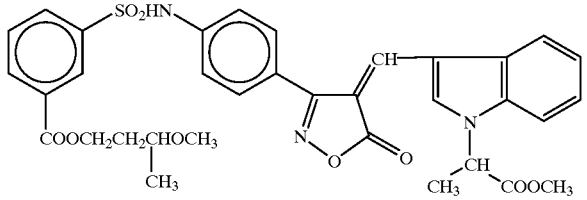

-continued
Cpd-1
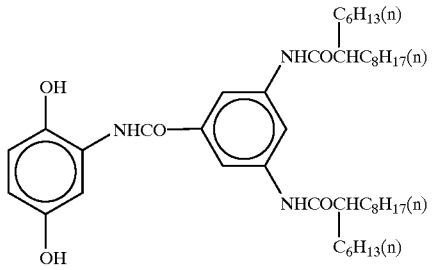
Cpd-2
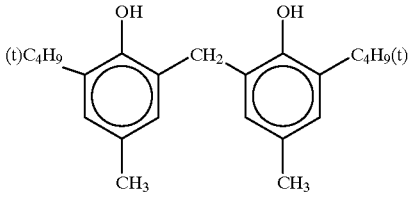
Cpd-3
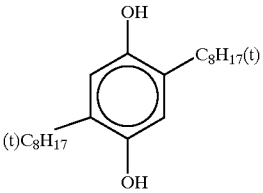
UV-1
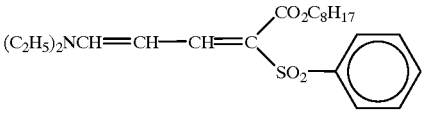
UV-2
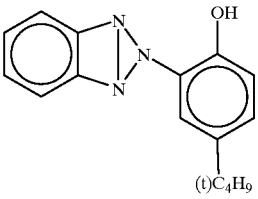
UV-3
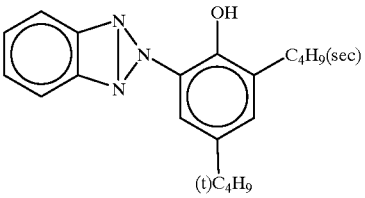
HBS-1
tricresylphosphate
HBS-2
di-n-butylphthalate
HBS-3
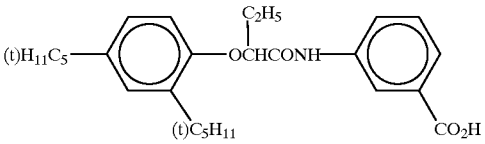
HBS-4
tri(2-ethylbexyl)phosphate -continued
ExS-1
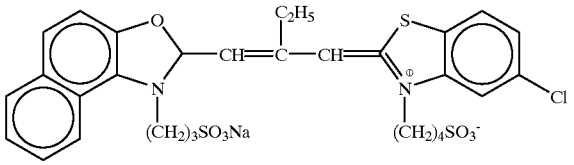
ExS-2
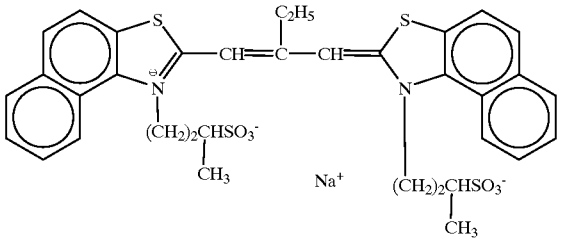
ExS-3
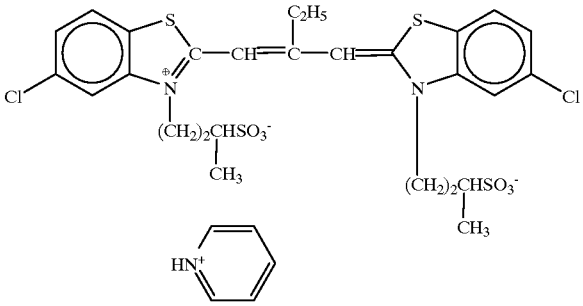
ExS-4
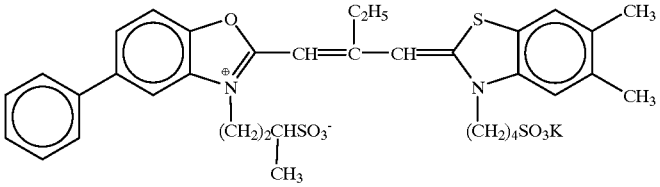
ExS-5
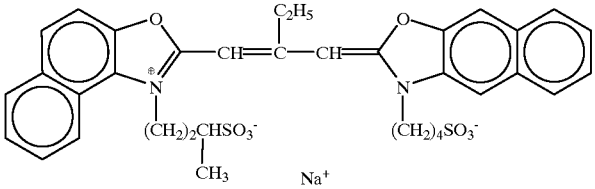
ExS-6
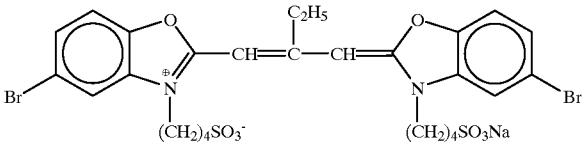
ExS-7
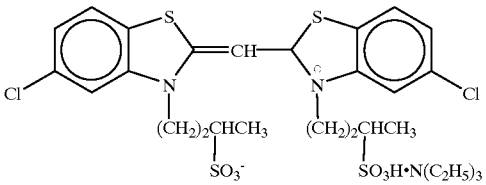

-continued
S-1
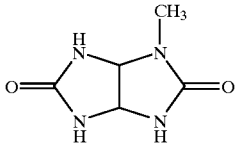
H-1
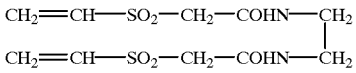
B-1
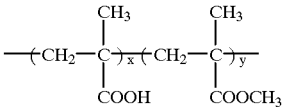
*x*/*y* = 10/90
(weight ratio)
Average molecular
weight: about 35,000
B-2
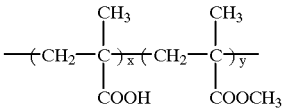
*x*/*y* = 40/60
(weight ratio)
Average molecular
weight: about 20,000
B-3
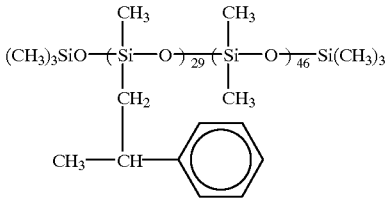
(mol. ratio)
Average molecular
weight: about 8,000
B-4
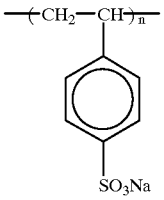
Average molecular
weight: about 750,000
B-5
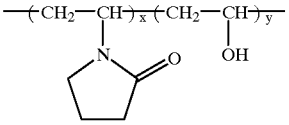
*x*/*y* = 70/30
(weight ratio)
Average molecular
weight: about 17,000
B-6
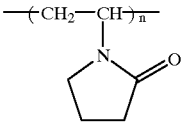
Average molecular
weight: about 10,000
W-1
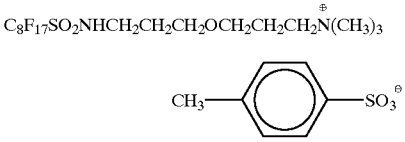
W-2
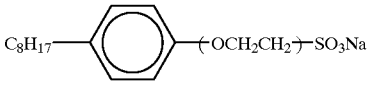
*n* = 2–4

-continued
W-3
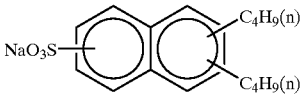
F-1
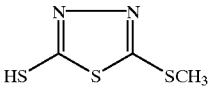
F-2
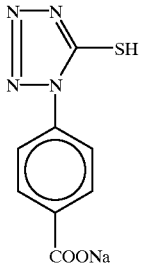
F-3
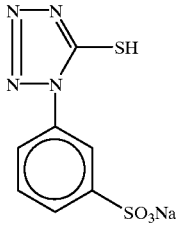
F-4
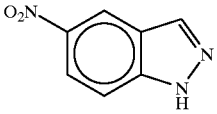
F-5
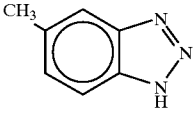
F-6
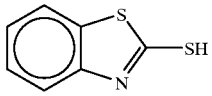
F-7
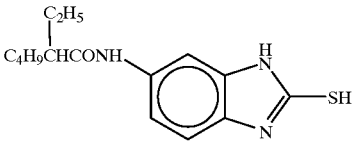
F-8
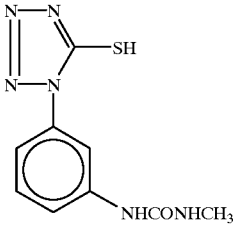

-continued

F-9

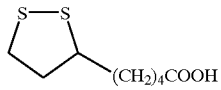

F-10

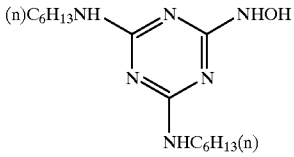

F-11

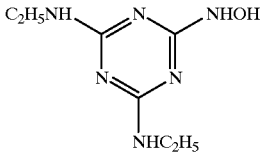

F-12

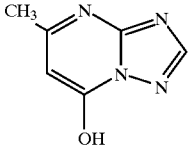

F-13

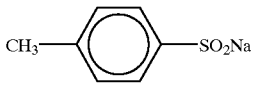

F-14

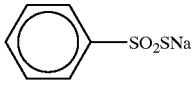

F-15

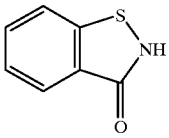

F-16

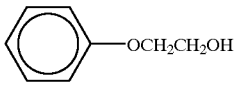

F-17

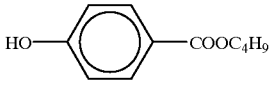

Samples were formed by using the dyes in the 5th, 9th, and 12th layers shown in Table 8, (XX-16), and p-quinone, and exposed following the same procedure as in Example 1 (except neither the SC-39 filter nor the SC-50 filter was used). The sensitivity is indicated by the relative value of the reciprocal of an exposure amount required to make the optical density higher by 0.1 than fog.

TABLE 8

| | 5th layer *) | 9th layer *) | 12th layer *) | Oxidizing agent |
|---|---|---|---|---|
| 2001 (Comparative Example) | 120 | 112 | 101 | XX-16 |
| 2002 (Present Invention) | 121 | 113 | 103 | " |

TABLE 8-continued

| | | | | |
|---|---|---|---|---|
| 2003 (Comparative Example) | 120 | 112 | 101 | p-quinone |
| 2004 (Present Invention) | 121 | 113 | 103 | " |

| | Cyan | | Magenta | | Yellow | |
|---|---|---|---|---|---|---|
| Sample No. | Sensitivity | Fog | Sensitivity | Fog | Sensitivity | Fog |
| 2001 (Comparative Example) | 100 (Reference) | 0.25 | 100 (Reference) | 0.37 | 100 (Reference) | 0.19 |
| 2002 (Present Invention) | 144 | 0.09 | 148 | 0.13 | 138 | 0.10 |
| 2003 (Comparative Example) | 96 | 0.25 | 96 | 0.37 | 91 | 0.19 |
| 2004 (Present Invention) | 132 | 0.12 | 137 | 0.16 | 128 | 0.10 |

*) The dyes used in the layer were placed with the dyes of emulsion numbers in Example 1 shown in this column.

It is evident from Table 8 that even in multilayered color films each of the samples using the emulsions No. 121, No. 114, and No. 103 of the present invention had a higher sensitivity and a lower fog than those of the samples using dyes of the comparative emulsions No. 120, No. 113, and No. 101.

It is also found that thiosulfonic acid (XX-16) is preferred to p-quinone as an oxidizing agent in the adjustment of a reduction-sensitized emulsion.

Example 3

1) Support

A support used in this example was formed by the following method.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant film was longitudinally oriented by 3.3 times at 140° C., laterally oriented by 3.3 times at 130° C., and thermally fixed at 250° C. for 6 sec. The result was a 90-μm thick PEN film. Note that this PEN film was added with proper amounts of blue, magenta, and yellow dyes (I-1, I-4, I-6, I-24, I-26, I-27, and II-5 described in Journal of Technical Disclosure No. 94-6023). The PEN film was wound around a stainless steel core 20 cm in diameter and given a thermal history of 110° C. and 48 hours, manufacturing a support with a high resistance to curling.

2) Coating of undercoat layers

The two surfaces of the support were subjected to corona discharger UV discharge, and glow discharge and coated with an undercoat solution (10 cc/m$^2$, by using a bar coater) consisting of 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, forming undercoat layers on sides at a high temperature upon orientation. Drying was performed at 115° C. for 6 min (all rollers and conveyors in the drying zone were at 115° C.).

3) Coating of back layers

On one surface of the undercoated support, an antistatic layer, a magnetic recording layer, and a slip layer having the following compositions were coated as back layers.

3-1) Coating of antistatic layer 0.2 g/m$^2$ of a dispersion (secondary aggregation grain size =about 0.08 μm) of a fine-grain powder, having a specific resistance of 5 Ω•cm, of a tin oxide-antimony oxide composite material with an average grain size of 0.005 μm was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of magnetic recording layer 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.3 g/m$^2$ of $C_2H_5C(CH_2OCONH{-}C_6H_3(CH_3)NCO)_3$ as a hardener and acetone, methylethylketone, and cyclohexane as solvents, forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-polyoxyethylene-propyloxytrimethoxysilane (polymerization degree 15, 15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, 7.3×10$^4$ A/m, and 65%, respectively.

3-3) Preparation of slip layer

Diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$) were coated. Note that this mixture was melted in xylene/propylenemonomethylether (1/1) at 105° C., dispersed in propylenemonomethylether (tenfold amount), and formed into a dispersion (average grain size 0.01 μm) in acetone before being added. 15 mg/m$^2$ of silica grains (0.3 μm) were added as a matting agent, and 15 mg/m$^2$ of 3-polyoxyethylene-propyloxytrimethoxysiliane (polymerization degree 15, aluminum oxide coated by 15 wt %, 0.15 μm) were added as a polishing agent. Drying was performed at 115° C. for 6 min (all rollers and conveyors in the drying zone were at 115° C.). The resultant slip layer was found to have excellent characteristics; i.e., the coefficient of kinetic friction was 0.06 (5 mmϕ stainless steel hard sphere, load 100 g, speed 6 cm/min), the coefficient of static friction was 0.07 (clip method), and the coefficient of kinetic friction between an emulsion surface (to be described later) and the slip layer was 0.12.

4) Coating of light-sensitive layers

The side away from the back layers obtained as above was coated with a plurality of layers having exactly the same compositions as in Example 2, thereby forming samples No. 3001 to No. 3004 listed in Table 9 to be presented later.

The light-sensitive material formed as above was cut into 24-mm wide, 160-cm long samples, and two square perforations of 2 mm side were formed at an interval of 5.8 mm in portions 0.7 mm away from one side in the widthwise direction along the longitudinal direction of the light-sensitive material. Two such sets were formed at an interval of 32 mm and packed in a plastic film cartridge explained in FIGS. 1 to 7 of U.S. Pat. No. 5,296,887.

These samples No. 3001 to No. 3004 were exposed in the same manner as in Example 2, processed as described below (running processing), and evaluated following the same procedure as in Example 2.

The light-sensitive material formed as above was exposed with white light and developed as follows by using an automatic processor FP-360B manufactured by Fuji Photo Film Co., Ltd. Note that FP-360B was modified such that the overflow solution of the bleaching bath was entirely discharged to a waste solution tank without being flowed to the succeeding bath. This FP-360B incorporates an evaporation compensating means described in JIII Journal of Technical Disclosure No. 94-4992.

The processing steps and the compositions of the processing solutions are described below.

(Processing method)

| Step | Time | Temperature | Quality of replenisher* | Tank volume |
|---|---|---|---|---|
| Color development | 3 min. 5 sec. | 37.8° C. | 20 ml | 11.5 l |
| Bleaching | 50 sec. | 38.0° C. | 5 ml | 5 l |
| Fixing (1) | 50 sec. | 38.0° C. | — | 5 l |
| Fixing (2) | 50 sec. | 38.0° C. | 8 ml | 5 l |
| washing | 30 sec. | 38.0° C. | 17 ml | 3 l |
| Stabilization (1) | 20 sec. | 38.0° C. | — | 3 l |
| Stabilization (2) | 20 sec. | 38.0° C. | 15 ml | 3 l |
| Drying | 1 min. 30 sec. | 60.0° C. | | |

*A quantity of replenisher is represented by a value per 1.1 m of a 35-mm wide sample (equivalent to one 24 Ex. film).

The stabilizing solution and the fixing solution were counterflowed from (2) to (1), and the overflow of washing water was entirely introduced to the fixing bath (2). Note that the amounts of the developer, the bleaching solution, and the fixing solution carried over to the bleaching step, the fixing step, and the washing step were 2.5 ml, 2.0 ml, and 2.0 ml, respectively, per 1.1 m of a 35-mm wide light-sensitive material. Note also that each crossover time was 6 sec, and this time was included in the processing time of each preceding step.

The aperture area of the processor was 100 $cm^2$ for the color developer, 120 $cm^2$ for the bleaching solution, and approximately 100 $cm^2$ for other processing solutions.

The compositions of the processing solutions are presented below.

| | Tank solution (g) | Replenishment solution (g) |
|---|---|---|
| (Color developer) | | |
| Diethylenetriamine pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylaminesulfate | 2.4 | 3.3 |
| 2-methyl-4-(N-ethyl-N-1-hydroxyethyl)amino) aniline sulfate | 4.5 | 6.5 |
| Water to make | 1.0 l | 1.0 l |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 l | 1.0 l |
| pH (controlled by ammonia water) | 4.6 | 4.0 |

(Fixing (1) tank solution)

A 5:95 (volume ratio) mixture of the above bleaching tank solution and the following fixing (2) tank solution.

(pH 6.8)

| (Fixing (2) Tank solution) | Tank solution (g) | Replenishment solution (g) |
|---|---|---|
| Aqueous ammonium thiosulfate solution (750 g/l) | 240 ml | 720 ml |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 l | 1.0 l |
| pH (controlled by ammonia water and acetic acid) | 7.4 | 7.45 |

(Washing water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizing solution) | common to tank solution and replenishment solution (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one sodium | 0.10 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 l |
| pH | 8.5 |

The evaluation results are summarized in Table 9 below. As is apparent from Table 9, each of the samples No. 3002 and No. 3004 of the present invention had a higher sensitivity and a lower fog than those of the comparative samples No. 3001 and No. 3003.

The influences of the presence/absence of the magnetic recording layer were also compared. In the comparative samples, the magnetic recording layer increased the fog and decreased the sensitivity. In contrast, in the samples using the dyes of the present invention, the presence/absence of the magnetic layer had no influence on the photographic properties, i.e., neither an increase in the fog nor a decrease in the sensitivity was found.

TABLE 9

| Sample No. | Sample No. of emulsion layer | Presence of Magnetic recording layer | Cyan Sensitivity | Cyan Fog | Magenta Sensitivity | Magenta Fog | Yellow Sensitivity | Yellow Fog |
|---|---|---|---|---|---|---|---|---|
| 3001 (Comparative Example) | 2001 | Yes | 100 (Reference) | 0.28 | 100 (Reference) | 0.38 | 100 (Reference) | 0.20 |
| 3002 (Present Invention) | 2002 | " | 145 | 0.09 | 151 | 0.13 | 139 | 0.10 |
| 3003 (Comparative Example) | 2003 | No | 104 | 0.26 | 102 | 0.37 | 102 | 0.19 |
| 3004 (Present Invention) | 2004 | " | 145 | 0.09 | 151 | 0.13 | 139 | 0.10 |

(Effect of the Invention)

By the present invention it is possible to obtain a high-image-quality, high-sensitivity silver halide photographic light-sensitive material in which fog is suppressed.

We claim:

1. A color silver halide photographic light-sensitive material comprising at least one cyan coupler containing layer, at least one magenta coupler containing layer and at least one yellow coupler containing layer formed on a support, wherein at least one of said at least one cyan coupler containing layer, at least one magenta coupler containing layer or at least one yellow coupler containing layer contains silver halide grains which are chemically sensitized in the presence of at least one compound represented by formula (III) below:

formula (III)

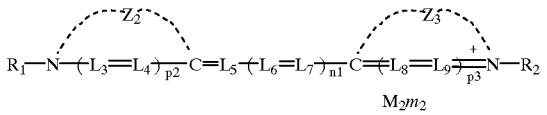

wherein each of $L_3$, $L_4$, $L_5$, $L_6$, $L_7$, $L_8$, and $L_9$ represents a methine group;

each of p2 and p3 represents 0 or 1;

n1 represents 1;

each of $Z_2$ and $Z_3$ represents atom groups required to form a 5- or 6-membered nitrogen-containing heterocyclic ring;

$M_2$ represents a charge-balancing counterion;

$m_2$ represents a number from 0 to 4 required to neutralize electric charge of a molecule; and each of $R_1$ and $R_2$ represents an alkyl group, provided that at least one of $R_1$ and $R_2$ is a group represented by R as follows:

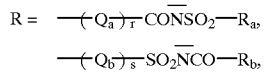

-continued

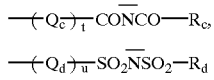

wherein each of $R_a$, $R_b$, $R_c$, and $R_d$ represents an alkyl group, an aryl group, a heterocyclic group, an alkoxy group, an aryloxy group, or an amino group, each of $Q_a$, $Q_b$, $Q_c$, and $Q_d$ represents a methylene group, and each of r, s, t and u represents an integer from 1 to 10; and said silver halide photographic light-sensitive material further comprises at least one compound represented by formulas (XX), (XXI), and (XXII) below:

Formula (XX) $R_{101}$-$SO_2S$-$M_{101}$

Formula (XXI) $R_{101}$-$SO_2S$-$R_{102}$

Formula (XXII) $R_{101}$-$SO_2S$-$(E)_a$-$SSO_2$-$R_{103}$ wherein each of $R_{101}$, $R_{102}$, and $R_{103}$ represents an aliphatic group, an aromatic group, or a heterocyclic group;

$M_{101}$ represents a cation;

E represents a divalent linking group; and a represents 0 or 1, wherein said silver halide grains are reduction-sensitized during the grain formation of silver halide grains.

2. The silver halide photographic light-sensitive material according to claim 1, further comprising a transparent magnetic recording layer.

3. The silver halide photographic light-sensitive material according to claim 1, wherein said silver halide grains are reduction-sensitized by the addition of reduction sensitizers.

4. The silver halide photographic light-sensitive material according to claim 3, wherein said silver halide grains are reduction-sensitized by using thiourea dioxide as said reduction sensitizers.

5. The silver halide photographic light-sensitive material according to claim 4, wherein said silver halide grains are tabular grains.

6. The silver halide photographic light-sensitive material according to claim 1, wherein said at least one compound selected from the group consisting of compounds represented by formulas (XX), (XXI), and (XXII) is represented by formula (XX).

7. The silver halide photographic light-sensitive material according to claim 1, wherein said at least one compound selected from the group consisting of compounds represented by formulas (XX), (XXI), and (XXII) is represented by formula (XXI).

8. The silver halide photographic light-sensitive material according to claim 1, wherein said at least one compound selected from the group consisting of compounds represented by formulas (XX), (XXI), and (XXII) is represented by formula (XXII).

9. The silver halide photographic light-sensitive material according to claim 1, wherein in formula (III), said 5- or 6-membered nitrogen-containing heterocyclic ring is selected from the group consisting of a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus, an imidazole nucleus, an imidazoline nucleus, a benzoimidazole nucleus, a 2-pyridine nucleus, a 4 quinoline nucleus, a 1-isoquinoline nucleus, a 3-isoquinoline nucleus, an imidazo(4,5-b) quinoxaline nucleus, an oxadiazole nucleus, a thiadiazole nucleus, a tetrazole nucleus, and a pyrimidine nucleus.

10. The silver halide photographic light-sensitive material according to claim 9, wherein said 5- or 6-membered nitrogen-containing heterocyclic ring is selected from the group consisting of a benzoxazole nucleus, a benzothiazole nucleus, a benzoimidazole nucleus, and a quinoline nucleus.

11. The silver halide photographic light-sensitive material according to claim 10, wherein said 5- or 6-membered nitrogen-containing heterocyclic ring is selected from the group consisting of a benzoxazole nucleus and a benzothiazole nucleus.

12. A silver halide photographic light-sensitive material comprising at least one cyan coupler containing layer, at least one magenta coupler containing layer and at least one yellow coupler containing layer formed on a support, wherein at least one of said at least one cyan coupler containing layer, at least one magenta coupler containing layer or at least one yellow coupler containing layer contains silver halide grains which are reduction-sensitized and then chemically sensitized in the presence of at least one compound represented by formula (III) below:

formula (III)

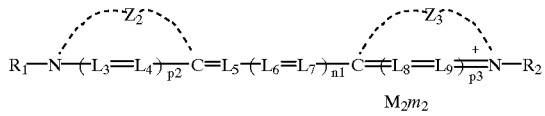

wherein each of $L_3$, $L_4$, $L_5$, L6, $L_7$, $L_8$, and $L_9$ represents a methine group;

each of p2 and p3 represents 0 or 1;

n1 represents 1;

each of $Z_2$ and $Z_3$ represents atom groups required to form a 5- or 6-membered nitrogen-containing heterocyclic ring;

$M_2$ represents a charge-balancing counterion;

$m^2$ represents a number from 0 to 4 required to neutralize electric charge of a molecule; and each of $R_1$ and $R_2$ represents an alkyl group, provided that at least one of $R_1$ and $R_2$ is a group represented by R as follows:

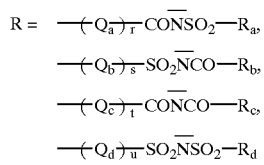

wherein each of $R_a$, $R_b$, $R_c$, and $R_d$ represents an alkyl group, an aryl group, a heterocyclic group, an alkoxy group, an aryloxy group, or an amino group, each of $Q_a$, $Q_b$, $Q_c$, and $Q_d$ represents a methylene group, and each of r, s, t and u represents an integer from 1 to 10; and said silver halide photographic light-sensitive material further comprises at least one compound represented by formulas (XX), (XXI), and (XXII) below:

Formula (XX) $R_{101}$-$SO_2S$-$M_{101}$

Formula (XXI) $R_{101}$-$SO_2S$-$R_{102}$

Formula (XXII) $R_{101}$-$SO_2S$-$(E)_a$-$SSO_2$-$R_{103}$ wherein each of $R_{101}$, $R_{102}$, and $R_{103}$ represents an aliphatic group, an aromatic group, or a heterocyclic group;

$M_{101}$ represents a cation;

E represents a divalent linking group; and a represents 0 or 1.

* * * * *